US005216473A

United States Patent [19]

Maeyama

[11] Patent Number: 5,216,473

[45] Date of Patent: Jun. 1, 1993

[54] COPYING METHOD AND COPYING APPARATUS FOR OBTAINING COLLATED DUPLEX COPIES FROM SIMPLEX DOCUMENTS

[75] Inventor: Kazuo Maeyama, Nara, Japan

[73] Assignee: Sharp Kabushiki Kaisha, Osaka, Japan

[21] Appl. No.: 742,280

[22] Filed: Aug. 8, 1991

Related U.S. Application Data

[63] Continuation of Ser. No. 417,572, Oct. 5, 1989, abandoned.

[30] Foreign Application Priority Data

Oct. 7, 1988 [JP] Japan ..... 63-254381

[51] Int. Cl.[5] ..... G03G 21/00

[52] U.S. Cl. ..... 355/319; 355/308; 355/320; 355/321; 355/322; 355/313

[58] Field of Search ..... 355/320, 329, 23, 24, 355/318, 208, 309, 321, 322, 323

[56] References Cited

U.S. PATENT DOCUMENTS

| | | | |
|---|---|---|---|
| 4,125,325 | 11/1978 | Batchelor et al. | 355/319 X |
| 4,355,880 | 10/1982 | Stemmle | 355/321 X |
| 4,384,782 | 5/1983 | Acquaviva | 355/318 |
| 4,466,733 | 8/1984 | Pels | 355/321 X |
| 4,512,651 | 4/1985 | Dunleavy, Jr. | 355/323 X |
| 4,536,078 | 8/1985 | Ziehm | 355/319 X |
| 4,561,772 | 12/1985 | Smith | 355/320 |
| 4,607,948 | 8/1986 | Naito | 355/319 X |
| 4,970,543 | 11/1990 | Ito et al. | 355/320 X |
| 4,980,729 | 12/1990 | Okamoto | 355/320 |
| 5,016,061 | 5/1991 | Tashiro et al. | 355/318 X |
| 5,091,755 | 2/1992 | Tashiro | 355/320 |
| 5,121,912 | 6/1992 | Tashiro | 271/902 X |

FOREIGN PATENT DOCUMENTS

| | | | |
|---|---|---|---|
| 0041301 | 12/1981 | European Pat. Off. | 355/320 |

*Primary Examiner*—R. L. Moses
*Assistant Examiner*—Matthew S. Smith

[57] ABSTRACT

When producing duplex copies from simplex original documents, the documents can be fed from the final page, but the copying method must be varied between the odd-number documents and even-number documents. Accordingly, the number of documents is counted while copying every other document from the final page, and the copying method is changed between the odd-number documents and even-number documents. Therefore, it is not necessary to count the number of documents before starting copying, and the time and labor required for producing duplex copies may be saved. Moreover, the copying apparatus can maintain the face-back relation during conveying and can invert the face-back relation during conveying the originals from storage into the exposure region, and also comprises the same two types of conveyors as the conveyors for the originals which two types convey from the exposure region to storage. Therefore, by using these four conveyors depending on the copying method and the document stacking state in storage, the original conveying time may be shortened, so that the time and labor required for producing duplex copies may be saved.

31 Claims, 25 Drawing Sheets

FIG(9)

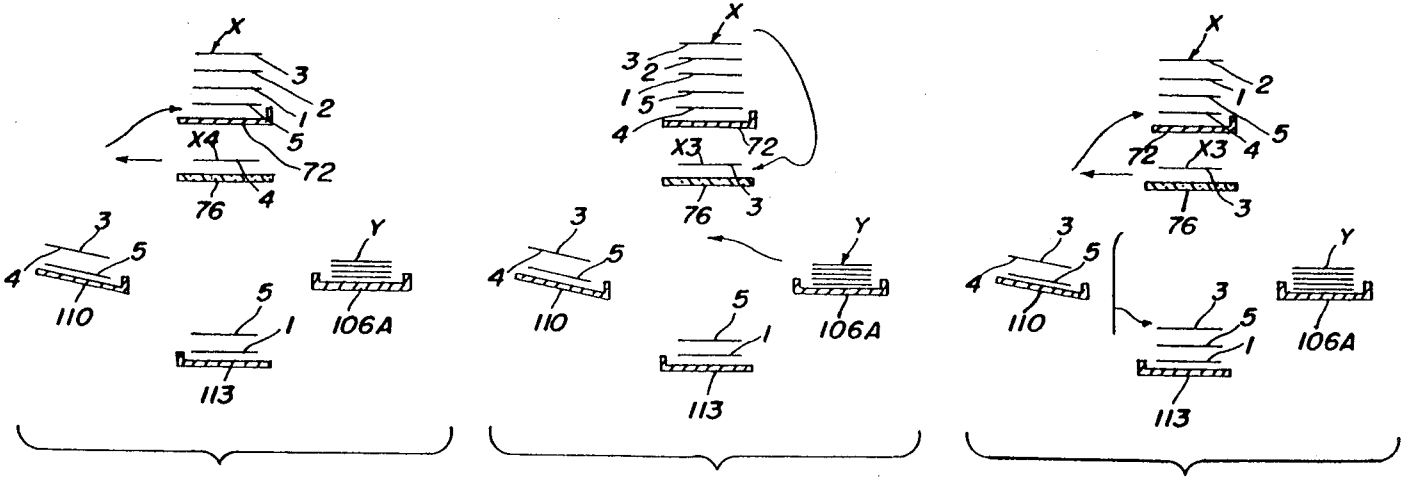
FIG. 5(13)
FIG. 5(14)
FIG. 5(15)
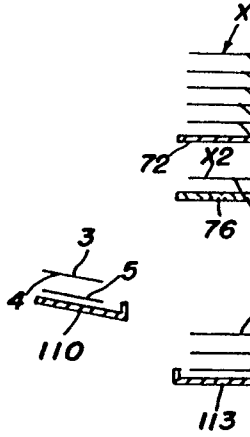
FIG. 5(16)
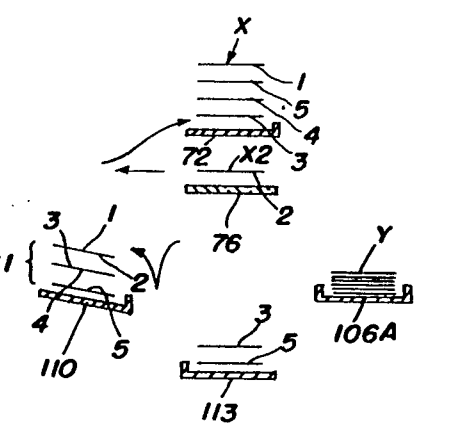
FIG. 5(17)
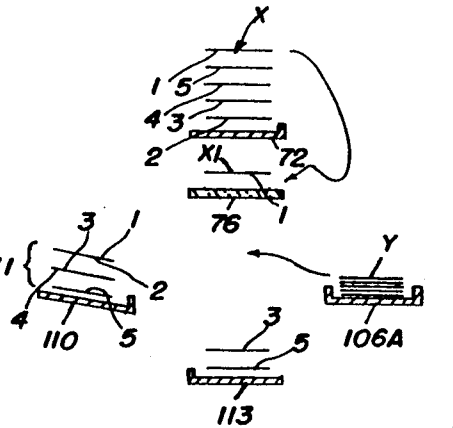
FIG. 5(18)

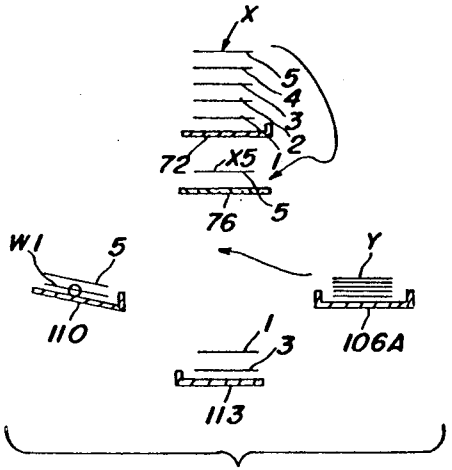
FIG. 5(19)
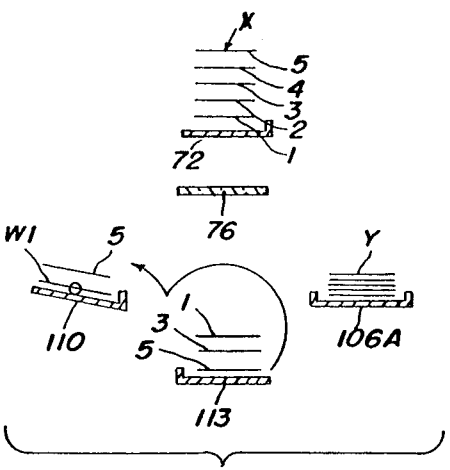
FIG. 5(20)
FIG. 5(21)
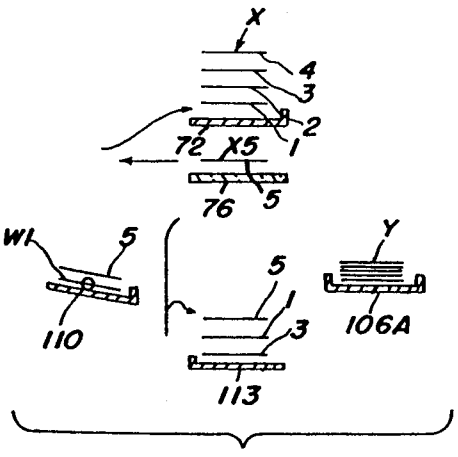
FIG. 5(22)
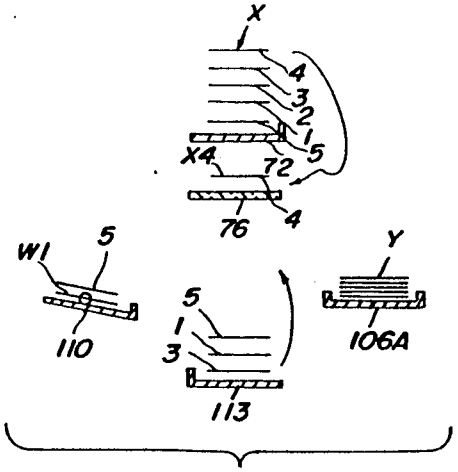
FIG. 5(23)
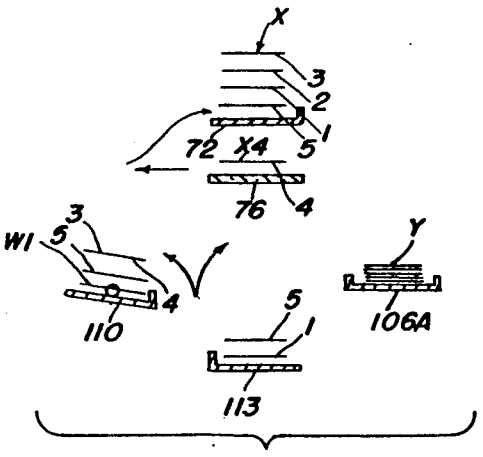
FIG. 5(24)

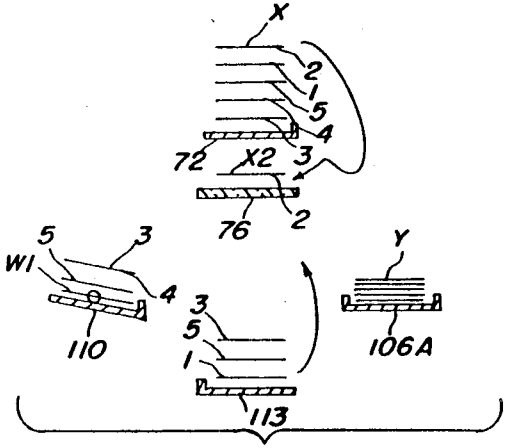
FIG.5(25)
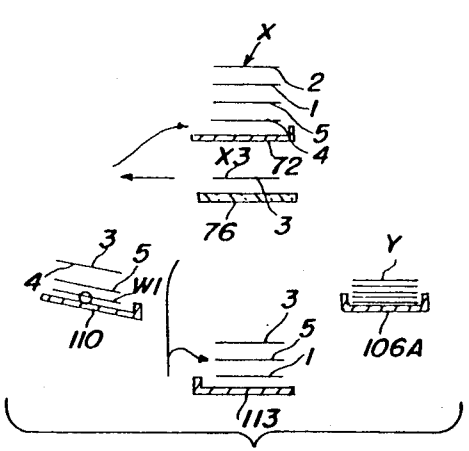
FIG.5(26)
FIG.5(27)
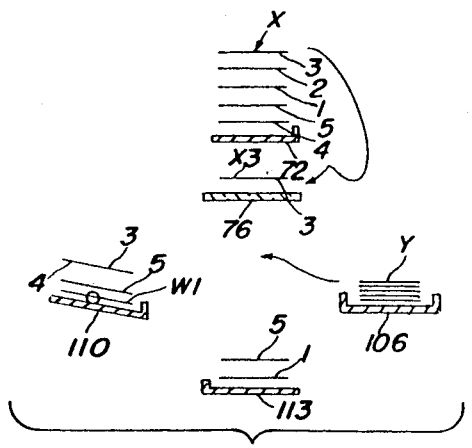
FIG.5(28)
FIG.5(29)
FIG.5(30)

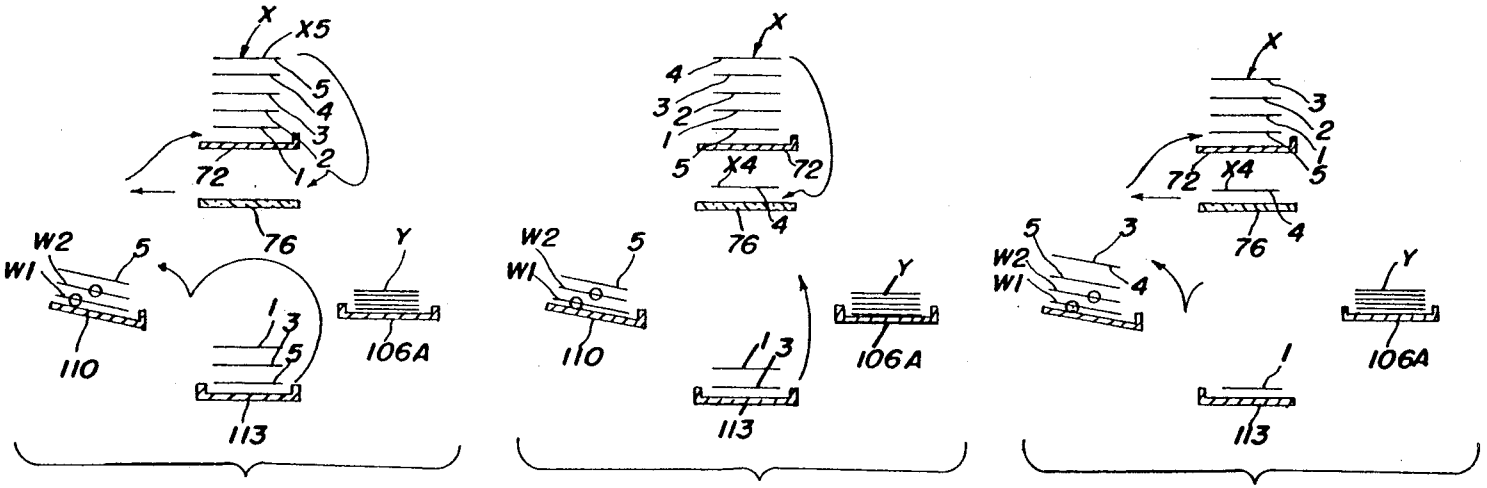
FIG. 5(31)
FIG. 5(32)
FIG. 5(33)
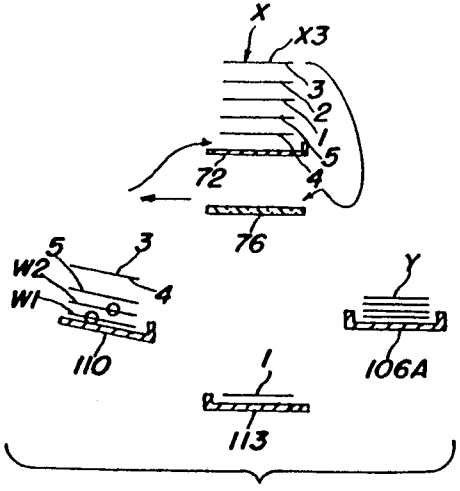
FIG. 5(34)
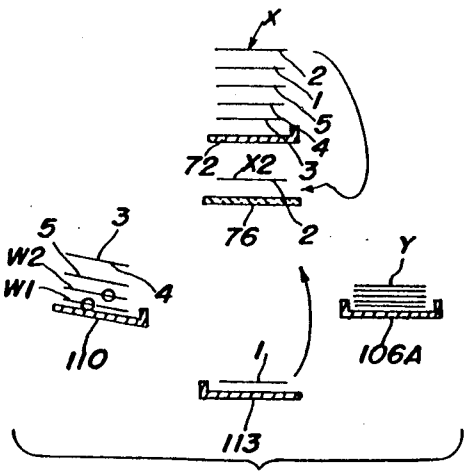
FIG. 5(35)
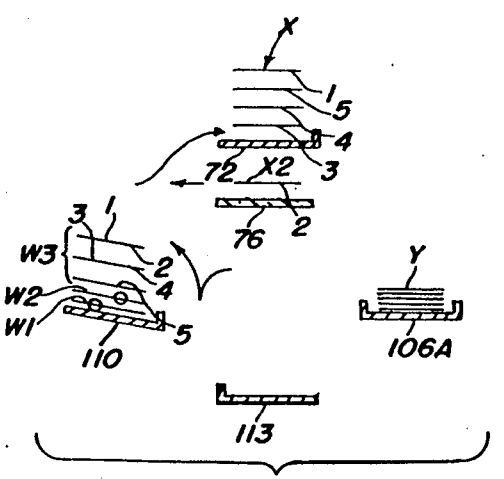
FIG. 5(36)

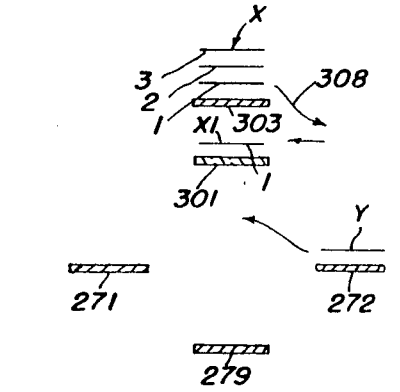
FIG. 10(1)
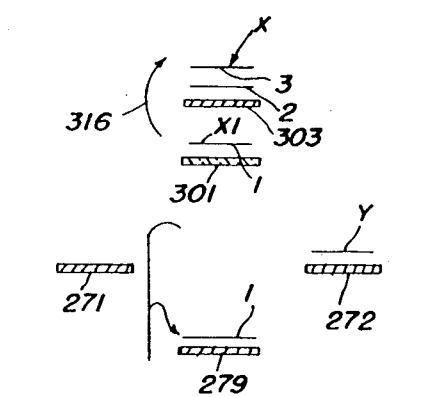
FIG. 10(2)
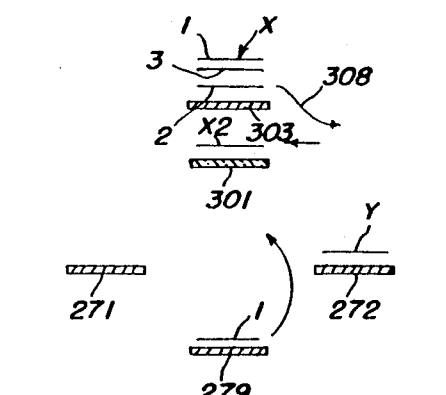
FIG. 10(3)
FIG. 10(4)
FIG. 10(5)
FIG. 10(6)

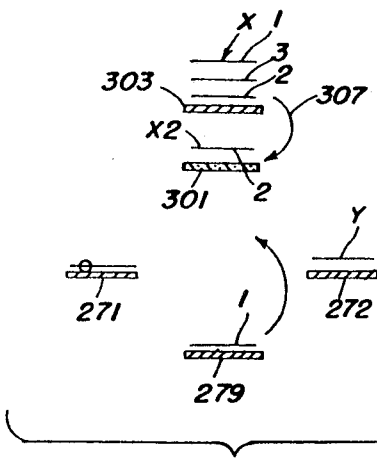
FIG.10(7)
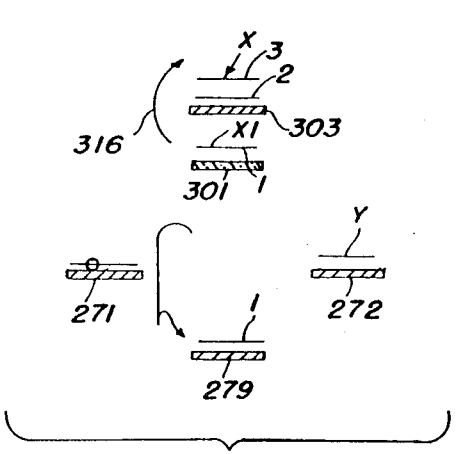
FIG.10(8)
FIG.10(9)
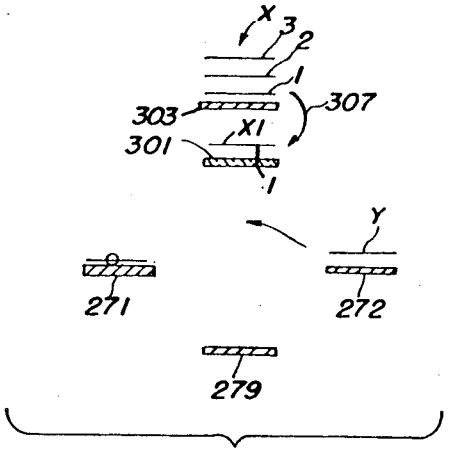
FIG.10(10)
FIG.10(11)
FIG.10(12)

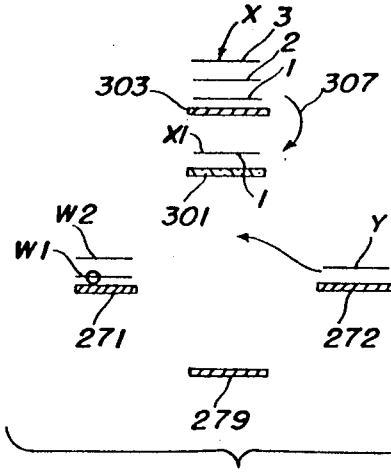
FIG. 10(13)
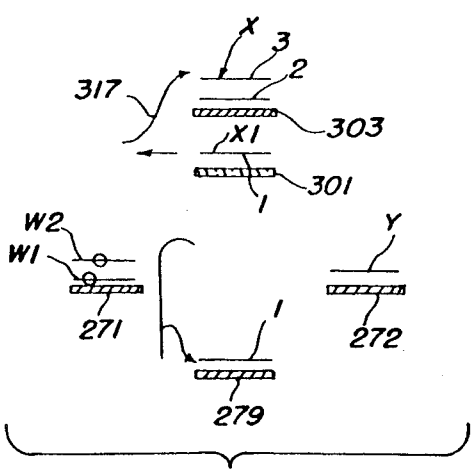
FIG. 10(14)
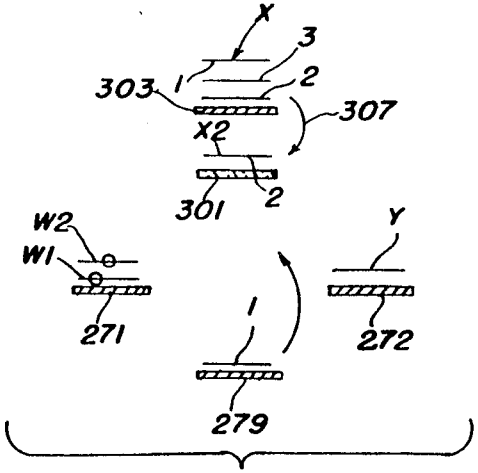
FIG. 10(15)
FIG. 10(16)
FIG. 10(17)
FIG. 10(18)

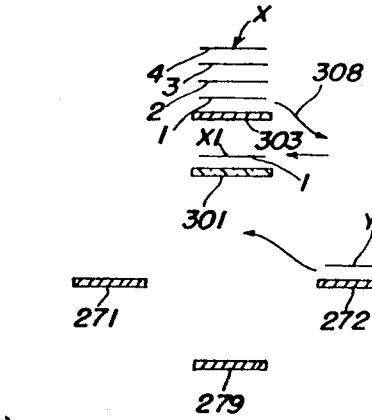
FIG. 11 (1)
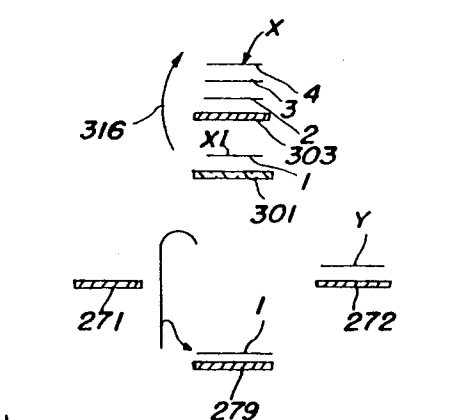
FIG. 11(2)
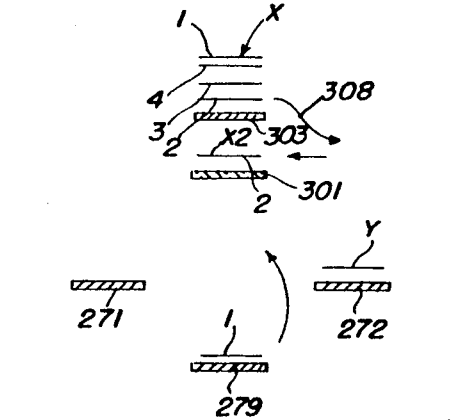
FIG. 11(3)
FIG. 11(4)
FIG. 11(5)
FIG. 11(6)

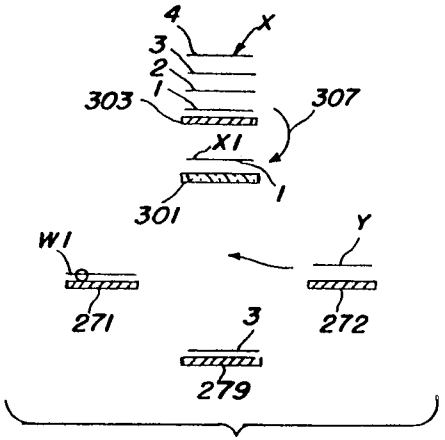
FIG. 11(9)
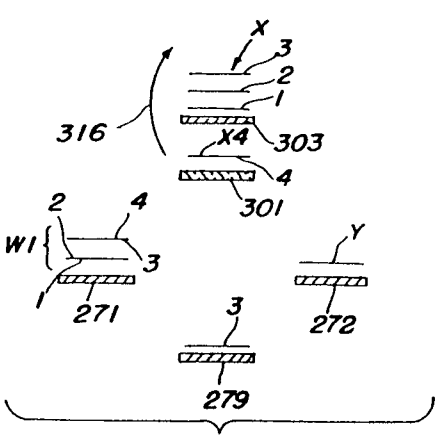
FIG. 11(8)
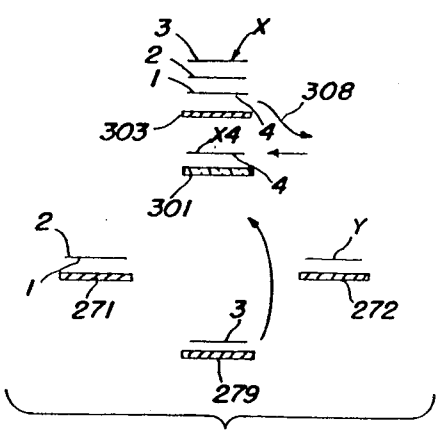
FIG. 11(7)
FIG. 11(12)
FIG. 11(11)
FIG. 11(10)

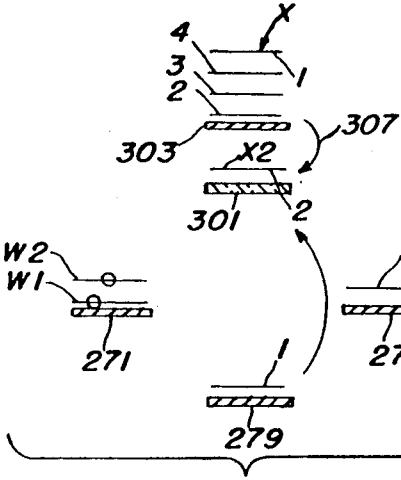
FIG. 11(19)
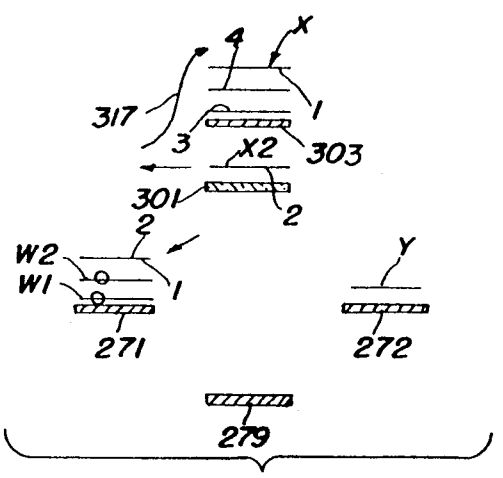
FIG. 11(20)
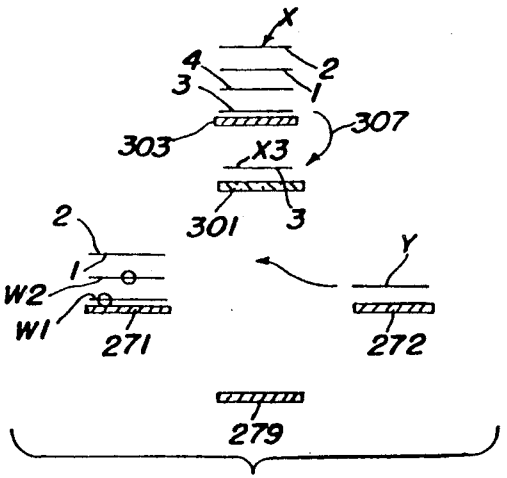
FIG. 11(21)
FIG. 11(22)
FIG. 11(23)
FIG. 11(24)

COPYING METHOD AND COPYING APPARATUS FOR OBTAINING COLLATED DUPLEX COPIES FROM SIMPLEX DOCUMENTS

This application is a continuation, of application Ser. No. 07/417,572 filed on Oct. 5, 1989, now abandoned.

BACKGROUND OF THE INVENTION

1. Field of the Invention

The present invention relates to a copying method and a copying apparatus for obtaining collated duplex copies from simplex documents preferably executed when obtaining duplex copies collated in the page sequence from a plurality of simplex documents.

2. Description of the Prior Art

In a copying apparatus, when it is desired to obtain duplex copies (copying papers duplicated on both sides of the sheet) from a plurality of simplex documents, two methods are known, that is, the method of copying from the final page of the original documents, and the method of copying from the first page thereof.

When copying from the final page, it is necessary to alter the copying method between the documents in an even number and the documents in an odd number. When the number of documents is an even number, the original side of the simplex documents is sequentially copied on both side of the copying paper, and the completely collated duplex copies are obtained. On the other hand, when the number of documents is an odd number, if the original side of the simplex documents is sequentially copied on both sides of copying paper the same as in the method of copying even-numbered documents, the other side of the copying paper on which the first page of the original document is copied on one side is a blank page, and the pagination of the duplex copies is deviated. Accordingly, the operator of the copying apparatus counts the number of documents, and enters either the odd number or the even number from the operation panel of the copier to select the copying method, or the documents are circulated before the copying operation to count the number in a copying apparatus furnished with a recirculating automatic document feeder (RADF) comprising a recirculating route in which the plurality of documents mounted on the document mounting member are sequentially conveyed, while being exposed in an exposure region, and are mounted again on the document mounting member.

Or in the method of copying from the first page of the simplex documents, it is not necessary to count the number of documents, but when feeding the documents into the copier, it is necessary to use, for example, an RADF in which the route of leading the document into the exposure region and the route of leading the document into the document hopper after exposure are the same.

When copying from the final page, manual counting of the number of documents is practically impossible when the number of documents is too many. Or when the RADF is designed to count the number of documents, the number of recirculating times of the documents increases, and it takes too much time when producing duplex copies, and the documents may be damaged.

Besides, in the case of copying from the first page, since the RADF having the identical route for leading the document into the exposure region and leading the document into the document hopper after exposure is used, it takes a long time to produce duplex copies.

SUMMARY OF THE INVENTION

It is hence a primary object of the invention to present a copying method and a copying apparatus for obtaining collated duplex copies from simplex documents capable of shortening the time required for obtaining collated duplex copies from a plurality of simplex documents.

To achieve this object, the invention presents a copying method for obtaining collated duplex copies from simplex documents comprising the steps of:

copying the simplex originals every other page from the final page on one side of copying papers, while counting the number of originals, preventing copying on the other side of the copying paper on which the final page of the original is copied when the number of originals is odd as a result of counting, and copying the remaining originals not copied at the time of counting in the reverse page sequence on the other side of the copying papers on which the originals of the second page from the final one and after are copied, and copying, when the number of originals is even, the remaining originals not copied at the time of counting in the reverse page sequence on the other side of the copying papers after the final page of the originals.

The invention also presents a copying apparatus for obtaining collated duplex copies from simplex documents comprising:

means for stacking up and storing the originals piled up in the page sequence, means for feeding the originals one by one from the final page from the storing means to an exposure region, means for returning the originals from the exposure region into the original storing means, means for copying the original image exposed in the exposure region into a copying paper, means of temporarily storing the copying papers after copying, means for conveying the copying papers from the copying paper storing means into the copying means, means for discharging copying papers after copying, and means for controlling for copying the originals every other page from the final page on one side of the copying papers while counting the number of originals in the first session of document feeding, storing the copying paper after copying into copying paper storing means, and, in the second session of document feeding, feeding the copying paper from copying paper storing means, when the number of originals is odd, discharging without copying on the other side of the copying paper on which the final page of the originals is copied, and copying the remaining originals not copied in the first session of document feeding in the reverse page sequence on the other side of the copying papers on which the second page from the final one and after the originals are copied, and, when the number of originals is even, copying the remaining originals not copied in the first session of document feeding in the reverse page sequence on the other side of the copying papers after the final page of the originals, and then discharging them.

Furthermore, the copying means of the invention comprises:

means for converting the original image after exposure into a toner image in a transferring region, means for storing the copying papers, and means for conveying the copying paper into transferring region for fixing the toner image.

The invention moreover presents a copying method for obtaining collaged duplex copies from simplex documents comprising the steps of:

feeding simplex original documents stacked up in the page sequence from bottom to top having the original side to be copied at the lower side, one by one from the bottom, exposing with the original side of the fed simplex original documents downward in the first copying operation to copy each page of the simplex original documents sequentially on both sides of copying paper, and stacking up the simplex original documents after being copied with the original side up, and conveying the simplex original documents with the original side up so that the original side may be at the lower side, and copying on the both sides in the second and subsequent operations.

The invention also presents a copying apparatus for obtaining collated duplex copies from simplex documents comprising:

means for stacking up and storing the originals piled up in the page sequence from bottom to top, with the lower side as the original side to be copied, means for feeding the originals one by one from the storing means, means for exposing the originals, first conveying means for conveying the originals into an exposure region while maintaining the face-back relation thereof, intervening between the feeding means and exposure means, first inverting means for inverting the originals conveyed into the exposure region by inverting the face-back relation thereof, intervening between the feeding means and exposure means, second inverting means for inverting the originals exposed in the exposure region returning into the uppermost part of the storing means by inverting the top-bottom relation, second conveying means for conveying the originals exposed in the exposure region returning into the uppermost part of the storing means while maintaining the top-bottom relation, means for controlling so as to, in the first copying operation, lead the originals fed from the storing means into the exposure region through the first conveying means, return the originals after exposure into the storing means through the second inverting means, and, when copying the final copy, to lead the originals fed from the conveying means into the exposure region through the first inverting means, return the originals after exposure into the storing means through the second conveying means, and, when copying other than the first and final copies, lead the originals fed from the conveying means into the exposure region through the first inverting means, and return the originals after exposure into the storing means through the second inverting means, and means for copying the exposed original images sequentially on both face and back sides of copying papers.

The first conveying means of the invention comprises:

first conveying member for conveying the originals from the feeding means, means for pooling the originals, and second conveying member for conveying the originals from the original pooling means into the exposure region.

The first conveying means of the invention also comprises:

means for orientation for guiding the originals from the feeding means into the original pooling means, and further guiding the originals from the original pooling means into the exposure region.

The first conveying means of the invention comprises:

means for guiding the originals from the feeding means by bending, and a pair of rollers for conveying the originals.

The feeding means of the invention comprises:

means for orientation for guiding the originals from the storing means into the first conveying means or first inverting means.

The second conveying means of the invention comprises:

first conveying member for conveying the originals from the exposure region, means for pooling the originals, and second conveying member for conveying the originals from the original pooling means into the storing means.

The second conveying means of the invention also comprises:

means for orientation for guiding the originals from the exposure region into the original pooling means, and further guiding the originals from the original pooling means into the storing means.

The second inverting means of the invention comprises:

means for guiding the originals from the exposure region by bending, and a pair of rollers for conveying the originals.

The copying apparatus of the invention also comprises:

means for orientation for guiding the originals from the exposure region into the second conveying means or second inverting means.

The copying means of the invention comprises:

means for converting the original image after exposure into a toner image to bring into the transferring region, means for storing the copying papers, means for conveying the copying papers into the transferring regions for fixing the toner image, and means for discharging the copying papers from the transfer conveying means.

According to the invention, when copying from the final page of the simplex documents, the originals are copied on one side of the copying papers every other page from the final one, while the number of originals is counted. As a result of counting, when the number of originals is odd, no copy is made on the other side of the copying paper on which the final page of the document is copied, and the remaining originals not copied at the time of counting are copied in the reverse page sequence on the other side of the copying papers on which the originals of the second page from the final one and after are copied.

When the number of originals is even as a result of counting, the remaining pages not copied at the time of counting are copied in the reverse page sequence on the other side of the copying papers copied every other page from the final one of the document.

When copying, therefore, it is not necessary to count the number of originals, and the time for producing duplex copies is shortened.

By this invention, moreover, when copying from the first page of simplex documents, the originals are stacked up in the page sequence from bottom to top with the original side to be copied down, and are fed one by one from the bottom. In the first copy, the originals are exposed with the original side down, and each page of the originals is copied sequentially on both sides of copying papers. In the second and subsequent copies, the originals after the first copy are stacked up with the original side up. The originals with the original side up are conveyed so that the original side may come down, and the originals are copied in the page sequence on both sides of copying papers.

Thus, according to the invention, the time required to obtain collated duplex copies from simplex documents in a copying apparatus is shortened, and the convenience of the copying apparatus is enhanced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects of the invention, as well as the features and advantages thereof, will be better understood and appreciated form the following detailed description taken in conjunction with the drawings which are given by way of illustration only, and thus are not limitative of the present invention, and in which.

DETAILED DESCRIPTION OF THE PREFERRED EMBODIMENTS

Figure 1:
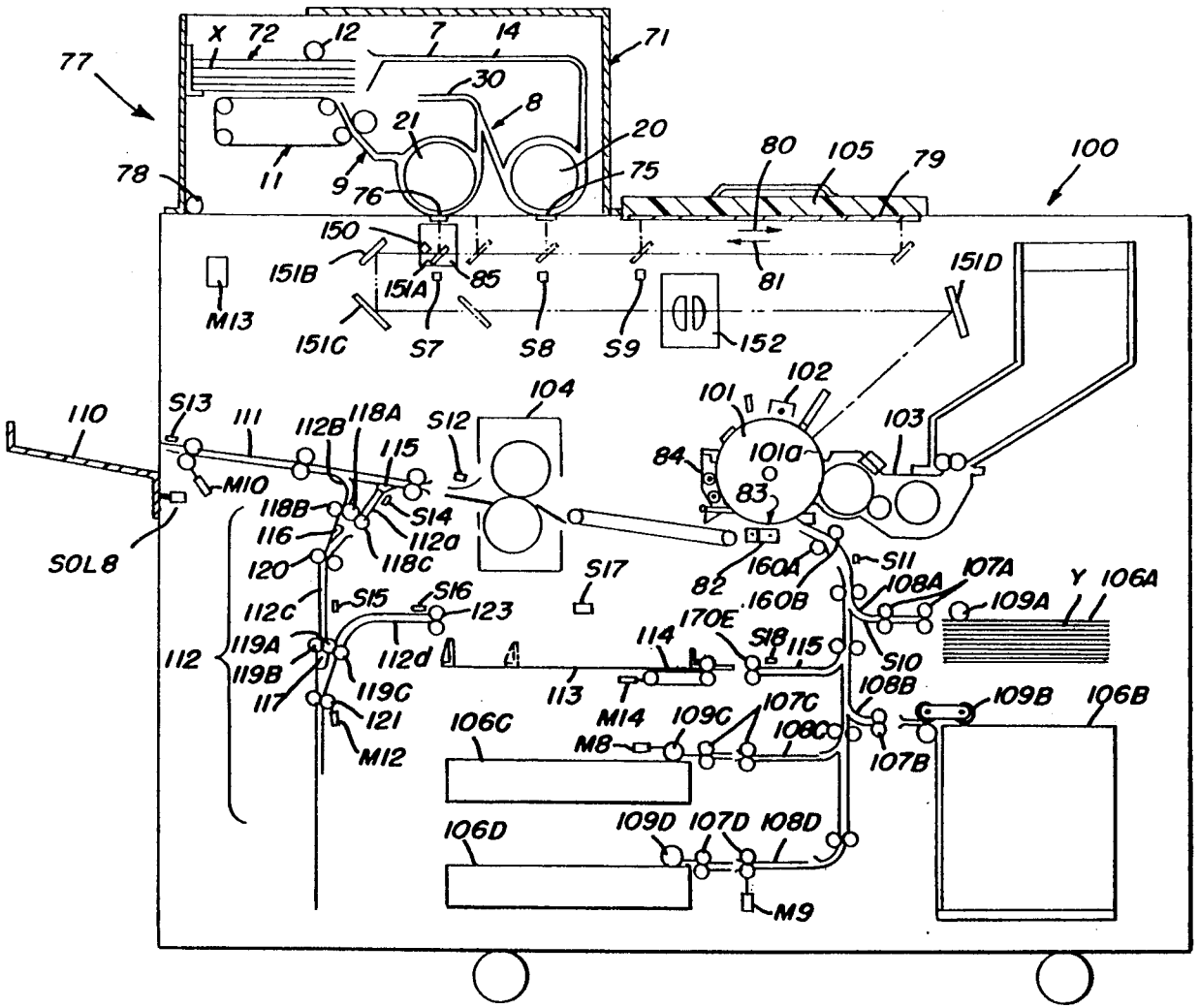
FIG. 1 is a sectional view showing a basic composition of a copying apparatus 77.

Referring now to the drawings, some of the preferred embodiments are described in detail below.

FIG. 1 is a sectional view showing a basic composition of an electrostatic copying apparatus (hereinafter called copying apparatus) 77 furnished with a recirculating automatic document feeder (hereinafter called RADF) 71. The RADF 71 is mounted on a copying apparatus main body 100 of the copying apparatus 77 so as to be rotatable about a rotary shaft 78. In the copying apparatus main body 100, on the top surface where the RADF 71 is fixed, an original platen 105 made of hard glass is disposed, and a presser 105 for pressing the original documents put on the original platen 79 is dislocatably disposed.

The copying action in this copying apparatus 77 is effected either by using the RADF 71, or by putting the documents on the original platen 79, and pressing the documents by the presser 105.

In the RADF 71, a plurality of the sheet documents X sequentially arranged, for example, in the page sequence are put on the original hopper 72 which is a document storing means. These sheet documents X are sequentially separated and fed from the uppermost side one by one into first conveying means 7 by the rotation of paper feed roller 12 which is a feeding means. The first conveying means 7 possesses a conveying route 14 from the horizontal direction downward a vertical direction and again to the horizontal direction, and when the sheet documents X are conveyed in this conveying route 14, the sheet documents X are inverted.

Relating to the conveying route 14, a first original drum 20 in right cylinderical shape possessing an axial line vertical to the sheet of paper in FIG. 1 is disposed. This first original drum 20 is positioned exactly above a first exposure region 75 comprising an exposure glass made of hard glass. The sheet documents X are taken up on the first original drum 20, and the original side at the outer side in the radial direction of the first original drum 20 is sequentially presented to the first exposure region 75.

The sheet documents X after presenting the original side are led into second conveying means 8. This second conveying means 8 has a face-back inverting route 30 for inverting the presenting side of the sheet documents X. The sheet documents X from the face-back inverting route 30 are taken up on the second original drum 30 having a circular shape. By the rotation of the second original drum 21, the original side at the outer side in the radial direction of the second original drum 21 of sheet documents X is presented to a second exposure region 76 disposed above the copying apparatus main body 100 corresponding to the position exactly beneath the second original drum 21. The original side presented to this second exposure region 76 is, therefore, the opposite side of the original side presented to the first exposure region 75.

The sheet documents X after presenting the original side to the second exposure region 76 are stacked up at the lowermost side of the plural sheet documents X mounted on the original hopper 72 by the function of an original conveying belt 11 which is a returning means as being led into the original hopper 72 from third conveying means 9.

Inside the copying apparatus main body 100, there is exposure means 85 which is conveyed by a motor M13 in the direction of arrows 80, 81, extending in the direction vertical to the sheet of paper in FIG. 1, relating to the copying apparatus main body 100. The exposure means 85 is composed of a copy lamp 150 such as halogen lamp, and a reflector 151A. The light generated from the copy lamp 150 is selectively absorbed corresponding to the original image on the original surface. The reflected light from the original surface is led so as to be focused in an exposure region 101*a* of a right cylindrical photoreceptor 101 possessing an axial line vertical to the sheet of paper in FIG. 1, by means of reflectors 151A, 151B, 151C, 151D and zoom lens 152.

Relating to the photoreceptor 101, there is a corona discharger 102 for uniformly charging the surface of the photoreceptor 101 before exposure. As the light corresponding to the original image is led into the exposure region 101*a*, the surface of the photoreceptor 101 is selectively destaticized, and thereby an electrostatic latent image is formed. This electrostatic latent image is convered into a sensible toner image by the function of a developer 103 disposed at the downstream side of rotating direction of the photoreceptor 101 from the exposure region 101*a*. This toner image is transferred onto a copying paper Y conveyed by the structure described below, in a transfer region 83, by the function of a corona discharger for transfer 82. The toner remaining on the surface of the photoreceptor 101 after transfer is removed by a cleaning device 84. The copying paper Y on which the toner image is transferred in the transfer region 83 is conveyed into a fixing device 104, where the toner image is heated and fixed.

The copying apparatus main body 100 has paper feed trays 106A, 106B, 106C, 106D containing copying papers of different sizes attached to its side wall. From one of these paper feed trays 106A to 106D, the copying papers mounted at the uppermost side are led one by one into paper feed routes 108A to 108D as the paper feed rollers 109A to 109D are selectively rotated by driving means such as motor M8. In the paper feed routes 108A to 108D and other paper feed route 115 from an intermediate tray 113 mentioned later, conveying rollers 107A to 107E are disposed individually, and these conveying rollers are rotated and driven by a motor M9. By the function of these conveying rollers 107A to 107E, the copying papers from the paper feed trays 106A to 106D and intermediate tray 113 which is a copying paper storing means are led into the vicinity of the transfer region 83 of the photoreceptor 101.

In the conveying route between the paper feed routes 108A to 108D and the vicinity of the transfer region 83 of the photoreceptor 101, there are resist rollers 160A, 160B, and the torque of the motor M9 is selectively transmitted to these resist rollers 160A, 160B through a clutch CLT1 mentioned later. In this way, synchronizing with the toner image formed on the surface of the photoreceptor 101, it is controlled to convey the copying paper Y.

A discharge tray 110 is attached to the side wall of the copying apparatus main body 100. This discharge tray 110 comprises a solenoid SOL8, and by exciting this solenoid SOL8 for a predetermined time, the discharge tray 110 is shifted in a direction vertical to the sheet of paper in FIG. 1. For example, when the solenoid SOL8 is excited to shift the discharge tray 110 in the direction to the nearer side of the sheet of paper in FIG. 1, when the solenoid SOL8 is excited next time, the discharge tray 110 is shifted in the direction form the face to the back side of the sheet of paper in FIG. 1. In this way, copying papers Y after plural copies of part of the document are sorted, and in this state, they are put on the discharge tray 110.

In relation to the discharge route 111 for discharging the copying papers Y after copying from the fixing device 104 into the discharge tray 110, branching off from this discharge route 111, there is an inverting route 112 for inverting the copying papers Y. The copying papers Y after copying from the fixing device 104 are discharged into the discharge tray 110 in three modes as follows, corresponding to the operation mode of the copying apparatus 77 determined by the setting operation by the operator as mentioned later.

(1) To pass the discharge route 111 to discharge directly into the discharge tray 110.

(2) To lead from the discharge route 111 into the inverting route 112, and to store temporarily in the intermediate tray 113 in order to copy on the other side of copying paper Y. The plural copying papers Y put on the intermediate tray 113 are sequentially led into the vicinity of the transfer region 83 of the photoreceptor 101 by way of the paper feed route 115 from the copying paper Y of the lowermost side by means of paper feed roller 114. The copying paper Y after transfer of toner image is led into the fixing device 104, and the toner image is heated and fixed, and then the copying paper Y is discharged into the discharge tray 110 through the discharge route 111.

(3) To lead from the discharge route 111 into the inverting route 112 to be inverted, and to lead again into the discharge route 111 to discharge into the discharge tray 110.

In order to realize these three methods, the inverting route 112 is composed of routes 112*a*, 112*b* branched off from two positions in the discharge route 111, a converging route 112*c* of these routes 112*a*, 112*b*, and a route 112*d* branching off from the route 112*c* and directing to the intermediate tray 113. At the branching part of the route 112*a* and discharge route 111, a gate flapper 115 is installed, and also a gate flapper 116 is disposed at the branching part of the routes 112*a* and 112*b*, and a gate flapper 117 at the branching part of the routes 112*c* and 112*d*, and they are respectively operated by solenoids (not shown), and the conveying route of the copying paper Y is automatically selected depending on the copy mode desired by the operator. Near the branching part of the routes 112*a* and 112*b*, rollers 118A, 118B, 118C are installed, and rollers 119A, 119B, 119C are disposed near the branching part of the routes 112*c* and 112*d*, thereby conveying the copying paper Y.

In the route 112*c* near the branching part of the routes 112*a* and 112*b*, an inverting roller 120 is installed, which is rotated in normal and reverse directions by a driving motor so as to invert the conveying direction of the copying paper Y, and another inverting roller 121 is installed at the downstream position of the branching part of the routes 112*c* and 112*d*, which is rotated in normal and reverse directions by a driving motor M12.

Furthermore, a discharge paper sensor S13 is installed near the outlet of the discharge route 111, paper inversion sensors S14, S15 near the inlet of the route 112*a* and in the route 112*c*, and an intermediate tray inlet sensor S16 near the outlet of the route 112*d*. Conveying rollers 112A to 112C are disposed along the discharge route 111, and a conveying roller 123 is disposed in the route 112*d*. The conveying rollers 112A to 112C are driven by the motor M10 in synchronism with the copying process components such as the photosensitive drum 102 and fixing device 104.

In this constitution, in the case of (1), the route 112*a* is closed by the gate flapper 115, and the copying paper Y is discharged along the discharge route 111. In the case of (2), the discharge route 111 is closed by the gate flapper 115, and the copying paper Y is led into the route 112*a* of the inverting route 112, and the route 112*c* is opened by the gate flapper 116, and the conveying direction is inverted at the inverting roller 121 through the route 112*c*, and also the route 112*d* is opened by the gate flapper 117, thereby leading the copying paper Y up to the intermediate tray 113. In the case of (3), after leading the copying paper Y into the route 112*c*, the conveying direction is inverted by the inverting roller 120, and the route 112*b* side is opened by the gate flapper 116, and the copying paper Y is led from the route 112*b* into the discharge route 111.

Figure 2:
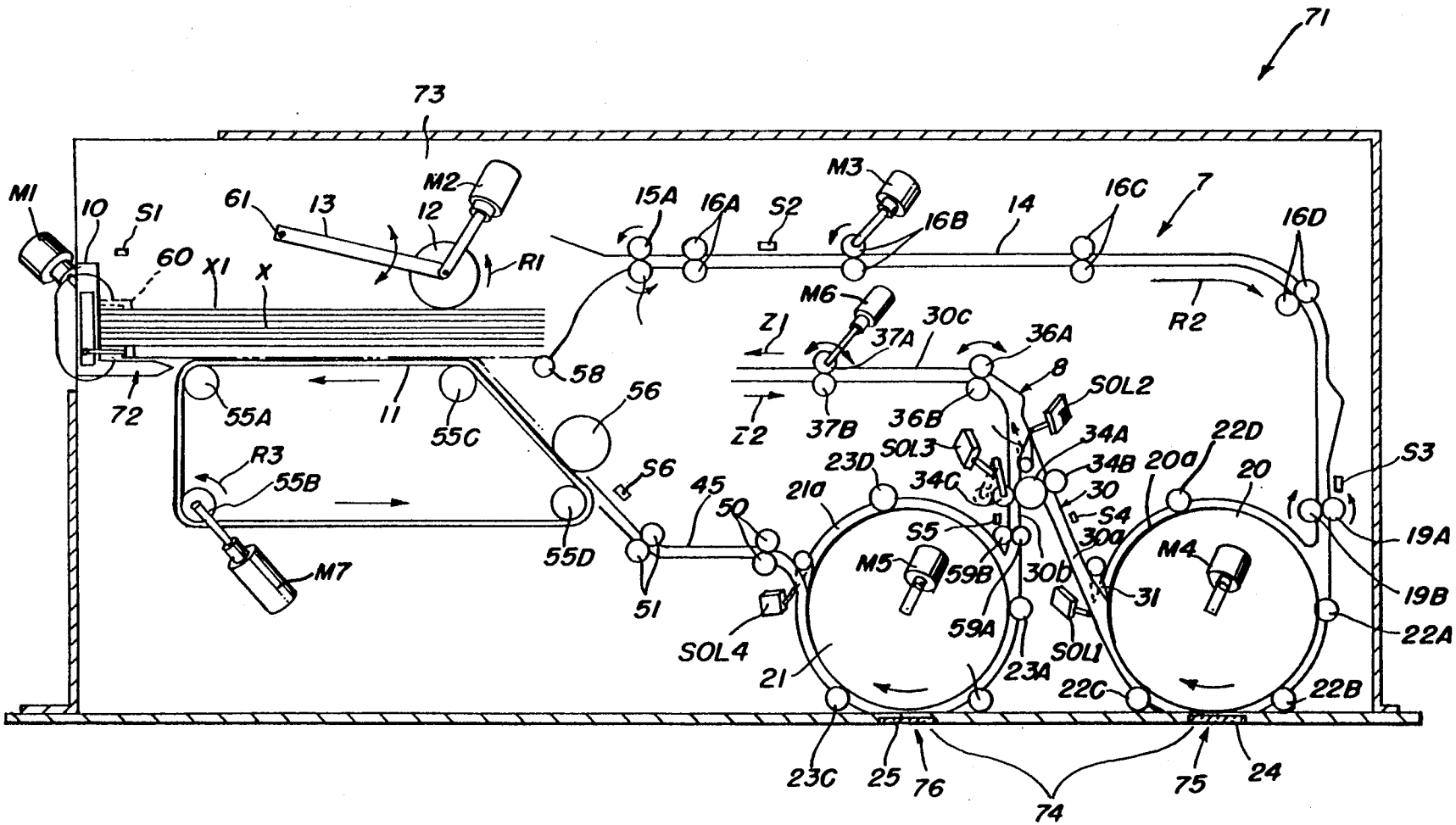
FIG. 2 is a sectional view showing the structure of a recirculating automatic document feeder (RADF) 71.

FIG. 2 is a sectional view showing a detailed structure of the RADF 71. On the original hopper 72, a plurality of sheet documents X collated in the page sequence having the image formed on one side are received, as being mounted on the conveying belt 11, with the end portion (the left side end portion in FIG. 2) aligned by a side end aligning member 10. The sheet documents X placed on the original hopper 72 are sequentially taken out by the feeding roller 12 from the uppermost side sheet document X1, and fed into the first conveying means 7.

The feeding roller 12 is rotated and driven in the direction of arrow R1 at a predetermined timing by the motor M2, and, during rotation, is pressed against the uppermost side sheet document X1 by the lever 13 angularly dislocated about the rotary axial line 61 by the structure including the solenoid and others (not shown). Or, the feeding roller 12 may be designed to always contact the sheet document X1 by gravity at the time of paper feed control of the sheet document X1.

Near the inlet of the conveying route 14 of the first conveying means 7, separating rollers 15A, 15B are installed in order to prevent duplicate feed of sheet documents X. The separating roller 15A is rotated and driven in the direction of conveying the sheet documents X, and the separating roller 15B is rotated and driven at a lower rotating speed than the rotating speed of the separating roller 15A in the direction of conveying the sheet documents X in the opposite direction of that conveying direction. Furthermore, the friction force between the separating roller 15B and the sheet documents X is selected smaller than the friction force between the separating roller 15A and the documents X.

Accordingly, the sheet documents X are conveyed securely one by one into the conveying route 14.

In the conveying route 14, pairs of conveying rollers 16A to 16D are disposed at intervals in the conveying direction. These conveying rollers 16A to 16D are rotated and driven by the motor M3, and the sheet documents X are held by these conveying rollers 16A to 16D, and are conveyed in the direction of arrow R2 within the conveying route 14.

Near the outlet of the conveying route 14 (near the first exposure region 75), a pair of resist rollers 19A, 19B are installed. These resist rollers 19A, 19B are linked to the drive shaft (not shown) through clutch CLT2 described below, and their rotation is started or stopped by the on/off control of the clutch CLT2.

The on/off control of the clutch CLT2 is controlled in response to the operation mode of the copying apparatus 77 determined by the operator. That is, when exposure of the sheet documents X is needed, the rotation of the resist rollers 19A, 19B is stopped in order to synchronize with the copying paper Y and the sheet documents X are once stopped, and when synchronized with the copying paper Y, the rotation is started again to feed the sheet documents X into the first exposure region 75. On the other hand, when exposure of the sheet documents X is not needed, the resist rollers 19A, 19B are always rotated, so that the sheet documents X may be passed without being stopped.

The sheet documents X conveyed by the resist rollers 19A, 19B are taken up on the first original drum 20 of right cylindrical shape installed right above the first exposure region 75, and are conveyed along the conveying route 20*a* to which the outer circumference of the first original drum 20 is opposite. In the conveying route 20*a*, plural driven rollers 22A to 22D are disposed at intervals in the peripheral direction of the first original drum 20, and when the first original drum 20 is rotated and driven by motor M4, the sheet documents X are conveyed as being held between the outer circumference of the first original drum 20 and the driven rollers 22A to 22D.

On the top of the copying apparatus main body 100 in the portion relating to the first exposure region 75, an exposure glass 24 made of hard glass and extending parallel to the axial line of the first original drum 20 is disposed. When exposed on the original surface at the outer side in the radial direction of the first original drum 20 of the sheet documents X taken up on the first original drum 20, the exposure means 85 in the copying apparatus main body 100 is stopped at a position relating to the first exposure region 75.

The second original drum 21 is disposed opposite to the second exposure region 76 so that its axial line may be parallel to the axial line of the first original drum 20, at a spacing from the first original drum 20. Relating to the second exposure region 76, an exposure glass 25 extending parallel to the axial line of the second original drum 21 made of hard glass is disposed. Relating to the outer circumference of the second original drum 21, a conveying route 21*a* is disposed, and in this conveying route 21*a*, driven rollers 23A to 23D are disposed at intervals in the peripheral direction of the second original drum 21.

Between the first original drum 20 and second original drum 21, second conveying means 8 possessing a face-back inverting route 30 for inverting the presentation side of the sheet documents X is disposed. The face-back inverting route 30 is composed of a first route 30*a* branched off from the portion opposite to the conveying route 21*a* of the conveying route 20*a* and extending obliquely upward, a second-route 30*b* extending upward from the portion opposite to the conveying route 20*a* of the conveying route 21*a* and converging with the first route 30*a*, and a third route 30*c* extending in the horizontal direction from the converging point of the first and second routes 30*a*, 30*b*. When the sheet documents X are led from the conveying route 20*a* into the third route 30*c* through the first route 30*a*, and are further led from this third route 30*c* into the conveying route 21*a* through the second route 30*b*, one original surface of the sheet documents X is presented to the first exposure region 75, while the other side is presented to the second exposure region 76.

In the portion where the first route 30a is branched off from the conveying route 20a, there is a gate flapper 31 which is driven by a solenoid SOL1, and the sheet documents X conveyed in the conveying route 20a are selectively led into the first route 30a. At the converging point of the first and second routes 30a, 30b, there is a gate flapper 35 which is driven by a solenoid SOL2, so that the sheet documents X from the third route 30c may be led securely into the second conveying route 30b.

In relation to the converging point of the first and second routes 30a, 30b, a roller 34A is disposed. In the first route 30a, a roller 34B contacting with this roller 34A is disposed, and in the second route 30b a roller 34C selectively contacting with the roller 34A by means of a solenoid SOL3 is disposed.

The sheet documents X are led into the third route 30c from the first route 30a by means of rollers 34A, 34B. In the third route 30c, pairs of conveying rollers 36A, 36B; 37A, 37B rotated and driven in normal and reverse directions by a motor M6 are disposed at intervals. By these conveying rollers 36A, 36B; 37A, 37B, the sheet documents X are first conveyed in the direction of arrow Z1, and when the rear end portions in the conveying direction pass through the converging point of the first and second route 30a, 30b, the rotating direction of the conveying rollers 36A, 36B; 37A, 37B is inverted to convey in the direction of arrow Z2. When the conveying direction of the sheet documents X in the third route 30c is inverted, the gate flapper 35 comes to the position indicated by solid line in FIG. 2, so that the sheet documents X are led into the second route 30b. The sheet documents X are conveyed in the second route 30b by the conveying rollers 34A, 34C, and are led into the conveying route 21a.

Near the converging point of the second route 30b and conveying route 21a, a pair of resist rollers 59A, 59B are disposed. The resist rollers 59A, 59B are linked to a drive shaft (not shown) through the clutch CLT3, and are rotated and stopped by the on/off control of the clutch CLT3. The on/off control of the clutch CLT3 is effected in response to the operation mode of the copier 77 determined by the operator.

That is, when exposure of the sheet documents X is needed, the rotation of the resist rollers 59A, 59B is stopped to synchronize with the copying paper Y, and conveying of the sheet documents X is temporarily stopped, and after synchronized with the copying paper Y, the rotation is started again to resume conveying to the second exposure region 76. On the other hand, when exposure of sheet documents X is not needed, the resist rollers 59A, 59B are always rotated, and the sheet documents X are led into the conveying route 21a without being stopped. In this operation, the solenoid SOL3 is controlled in response to the rotating motion of the resist rollers 59A, 59B, or the on/off control of the clutch CLT3.

The sheet documents X led into the conveying route 21a by the resist rollers 59A, 59B are conveyed in the conveying route 21a as being held between the outer circumference of the second original drum 21 and the driven rollers 23A to 23D as the second original drum 21 is rotated and driven by the motor M5. Thus, in the second exposure region 76, the original surface at the outer side in the radial direction of the second original drum 21 of the sheet documents X is sequentially presented. When the original surface presented at this time is exposed, the exposure means 85 is fixed right below the second exposure region 76.

In the third conveying means 9, a conveying route 45 for leading the sheet documents X from the conveying route 21a to the vicinity of the conveying belt 11 is disposed so as to be branched off from the conveying route 21a. At the branching position of the conveying route 45 from the conveying route 21a, there is a gate flapper 46 for selectively leading the sheet documents X into the conveying route 45, being driven by a solenoid SOL4. In the conveying route 45, pairs of conveying rollers 50, 51 are disposed at intervals. As the conveying rollers 50, 51 are rotated and driven, the sheet documents X are led into the conveying belt 11.

The conveying belt 11 is applied on the driving rollers 55A to 55D which are disposed in upper, lower, right and left positions. The driving roller 55B is rotated and driven in the direction of arrow R3 shown in FIG. 2 by a motor M7, so that the conveying belt 11 is driven in circulatory motion. Near the outlet of the conveying route 45 of the third conveying means 9, there is a sensor S6 for detecting the front end of the sheet documents X, and in response to the output from this sensor S6, the motor M7 is excited or de-excited. At the position near the outlet of the conveying route 45, there is an original lead-in roller 56 contacting with the conveying belt 11. The sheet documents X from the conveying route 45 are held between this original lead-in roller 56 and conveying belt 11, and led into the original hopper 72, and stacked up from the lowermost side.

At the lower side of the side end portion near the inlet of the conveying route 14 of the sheet documents X, an original rear end kick-up roller 58 is disposed, and the opening is securely widened so that the sheet documents X may be stacked up at the lowermost end portion by kicking up the rear end portion lower side of the sheet documents X. The motor M7 is stopped when the end portion of the downstream side in the conveying direction of the sheet documents X conveyed by the conveying belt 11 reaches the end aligning member 10.

The original hopper 72 is provided with an actuator for detection 60 for detecting the full circulation of presentation of mounted plural sheet documents X. This actuator for detection 60 is positioned at the lowest end indicated by solid line in FIG. 2 before the sheet documents X are put in the original hopper 72, and the sheet documents X are put thereon by the operator. The sheet documents X after presenting the original surface in the first and second exposure regions 75, 76 are sequentially stacked up at the lower side of the actuator 60, so that the actuator 60 ascends gradually. In this way, when the presentation of the sheet documents X is finished in full circulation, it reaches the highest position indicated by broken line in FIG. 2. When the actuator 60 reaches the highest position, it is detected by the sensor S1. By the output of this detector S1, as mentioned below, the operation of the copying apparatus main body 100 side is controlled. Moreover, when the actuator 60 reaches the highest position, the actuator driving motor M1 is energized, and the actuator 60 is rotated 360 degrees to be moved to the position of the lowest end of the sheet documents X.

In the conveying route 14, near the downstream side in the conveying direction of the sheet documents X below the separating rollers 15A, 15B, a sensor S2 for detecting the sheet documents X is disposed, and in response to the output from the sensor S2, the motor M3 is energized or de-energized. A sensor S3 is disposed at the upstream side in the conveying direction of the sheet documents X above the resist rollers 19A, 19B disposed in the conveying route near the first original drum 20. This sensor S3 is for detecting the leading end of the sheet documents X, and in response to its output, the motor M3 is controlled, and the clutch CLT2 disposed in relation to the resist rollers 19A, 19B is controlled in on/off switching.

In the face-back inverting route 30 of the second conveying means 8, a sensor S4 is provided in the first route 30*a*. In response to the output from this sensor S4, the motor M6 is driven and controlled, and the solenoid SOL2 is further controlled. In this way, the face-back inverting action of the sheet documents X is realized in the second conveying means 8.

There is a sensor S5 at the upstream side in the conveying direction of the sheet documents X above the resist rollers 59A, 59B disposed in the second route 30*b* near the second original drum 21. In response to the output from this sensor S5, the solenoid SOL3 is controlled, and also the operation of the clutch CLT3 disposed in relation to the resist rollers 59A, 59B is controlled.

In the copying apparatus 77 having thus composed RADF 71, by recirculating a plurality of sheet documents X plural times, for example, the following copying actions may be realized.

(A) The action to obtain a plurality of sorted simplex copy sheets from simplex documents.

(B) The action to obtain a plurality of sorted duplex copy sheets from simplex documents.

(C) The action to obtain a plurality of sorted simplex copy sheets from duplex documents.

(D) The action to obtain a plurality of sorted duplex copy sheets from duplex documents.

Furthermore, for example, by exposing with the sheet documents X kept wound on the first and/or second original drums 20, 21 of the RADF 71, a plurality of copies may be obtained during one circulation of sheet documents X.

Figure 3:
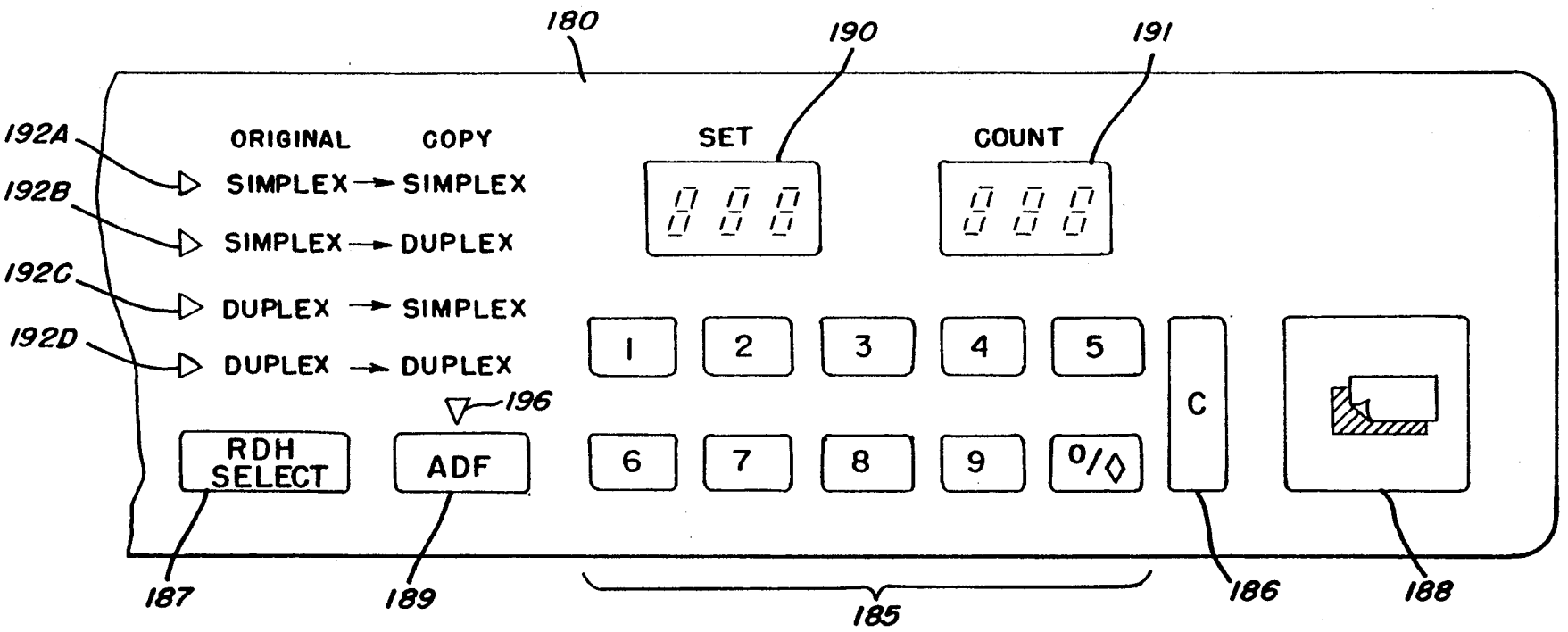
FIG. 3 is a plan view of an operation panel 180.

FIG. 3 is a plan view of part of an operation panel 180 disposed, for example, on the top of the copying apparatus main body 100. The operation panel 180 comprises numeric keys 185 for setting the number of copies, a clear key 186, copy mode selection key 187 for setting the copying conditions, RADF function key 189 for activating/inactivating the RADF 71, print switch 188 for instructing the start of copying operation, set number display part 190 for indicating the number of copies set by the numeric keys 185, copy number display part 181 for displaying the number of sheet copied, copy mode display parts 192A to 192D to display the copy mode selected by the copy mode selection key 187, and RADF function mode display part 196. The copy mode display parts 192A to 192D and RADF function mode display part 196 are composed of, for example, light emitting diodes, and when each mode is selected, the corresponding light emitting diode is lit up.

The copy mode display parts 192A to 192D show the four copy modes (A) to (D) shown above, that is, to obtain simplex copy from simplex original documents (SIMPLEX—SIMPLEX), to obtain duplex copy from simplex original documents (SIMPLEX—DUPLEX), to obtain simplex copy from duplex original documents (DUPLEX—SIMPLEX), and to obtain duplex copy from duplex original documents (DUPLEX—DUPLEX), and every time the copy mode selection key 187 is pressed, the mode is sequentially selected from above, and the corresponding light emitting diode (not shown) of display parts 192A to 192D is lit. However, when the copy mode selection key 187 is operated while the copy mode display part 192D is lit, the copy mode is changed to SIMPLEX—SIMPLEX shown in the copy mode display part 192A.

The RADF 71 is activated when the RADF function mode display part 196 is lit as the RADF function mode key 198 is pressed, and is inactivated when it is put out. That is, the operator, when putting an original document such as a book on the original platen 79 so as to obtain the copy images on the copying papers Y, operates the RADF function key 189 to put out the RADF function mode display part 196. Or when copying by conveying sheet documents X by using the RADF 71, the key is operated to light up the RADF function mode display part 196.

When the RADF function is used, the operator sets the copy mode as shown above by the operation of the copy mode selection key 187. Then, using numeric keys 185, the number of copies required is set. At this time, the determined number of copies is displayed in the set number display part 190. In succession of the operation of the numeric keys 185, when the print switch 188 is pressed, the RADF 71 and the copying apparatus main body 100 cooperate to start the copying action. At this time, the number of copies finished is sequentially shown in the copy number display part 191. In this way, when the set number shown in the set number display part 190 and the copy number shown in the copy number display part 191 coincide, the operation of the copying apparatus 77 stops, and the display of the set number display part 190 is reset to zero. The display in the copy number display part 191 at this time is maintained and is not reset, until the print switch 188 is again operated.

Figure 4:
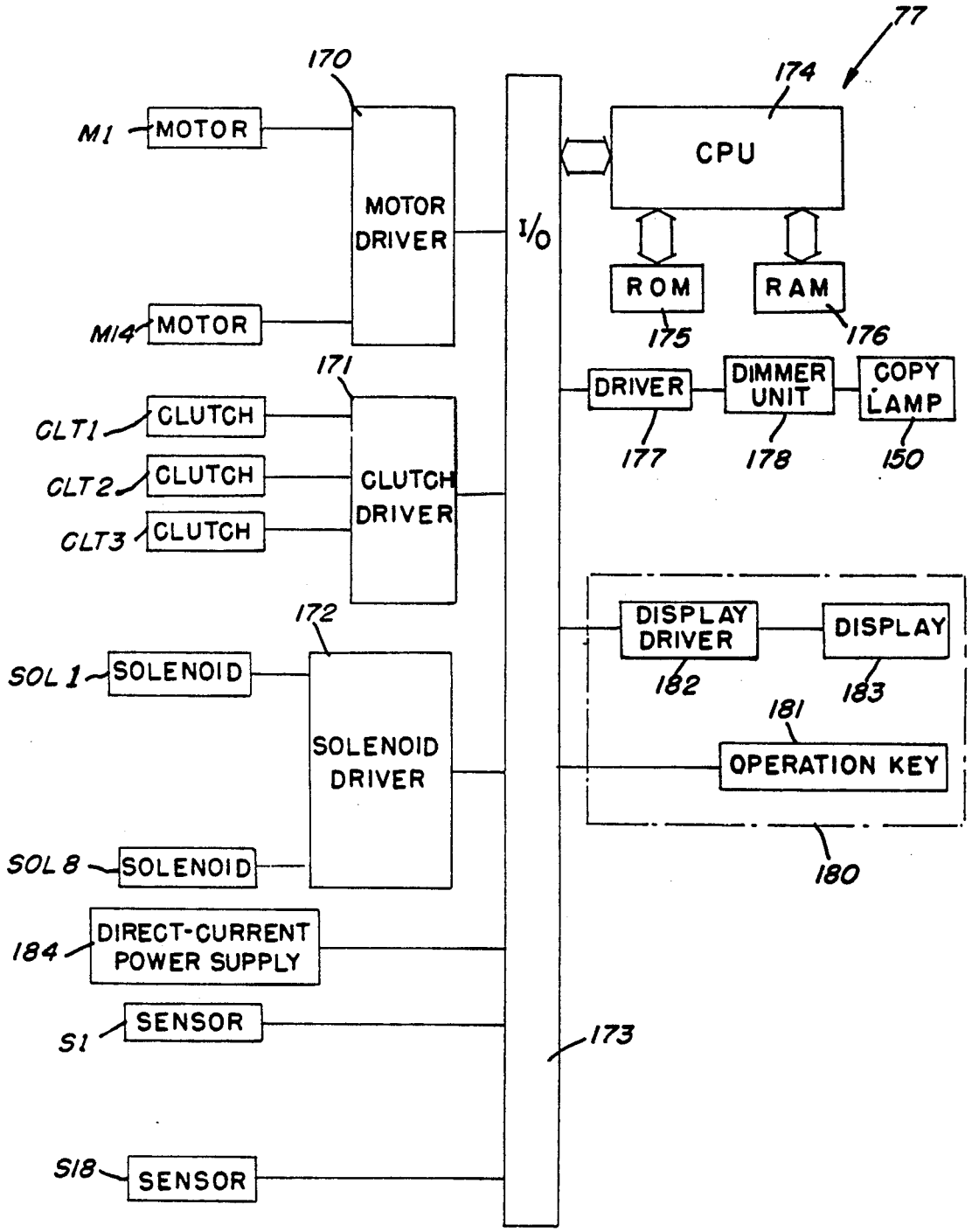
FIG. 4 is a block diagram showing an electric composition of a copying apparatus 77.

FIG. 4 is a block diagram showing an electrical composition of the copying apparatus 77. The plural motors M1 to M13 are connected to the motor driver 170, the clutches CLT1 to CLT3 are connected to the clutch driver 171, and plural solenoids SOL1 to SOL8 are connected to the solenoid driver 172. These drivers 170 to 172, and control elements used in original conveying control, copying paper conveying control and copying process control, including direct-current power supply 184, are connected to an interface circuit (I/O) 173. To this interface circuit 173, plural sensors S1 to S18 are also connected, and moreover a microcomputer (CPU) 174 is connected. Signals from the sensors S1 to S18 are given to the microcomputer 174, in which arithmetic processing corresponding to these signals is done, and drive control signals are sent to the drivers 170 to 172 through the interface circuit 173.

The microcomputer 174 comprises ROM (read-only memory) 175 and RAM (random access memory) 176. The microcomputer 174 controls and operates according to the control program stored in the ROM 175, using the memory region of the RAM 176 as the working region.

The interface circuit 173 is connected to a dimmer unit 178 for powering the copy lamp 150 of the exposure means 85 through a driver 177, gives display control signal to each display 183 (including display parts 190, 191, 192A to 192D, 196) of the operation panel through display driver 182, and is connected to operation keys 181 (including keys 185, 186, 187, 188, 189).

Figure 5:
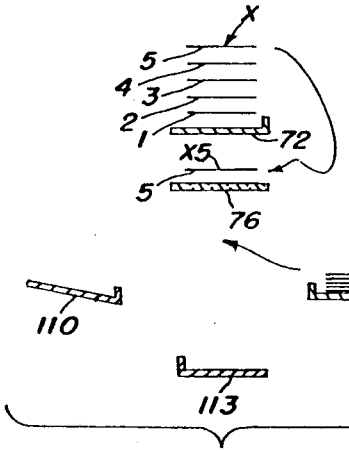
FIGS. 5(1)-5(38) are is a simplified sectional views for explaining the copying action for obtaining duplex copies from an odd number of simplex documents in the copying apparatus 77.
Figure 5:
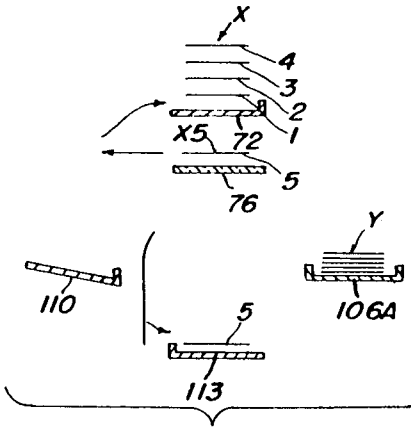
Figure 5:
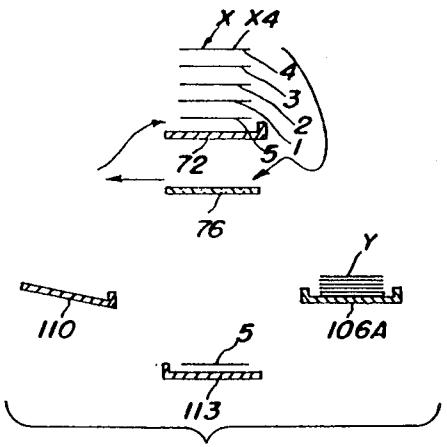
Figure 5:
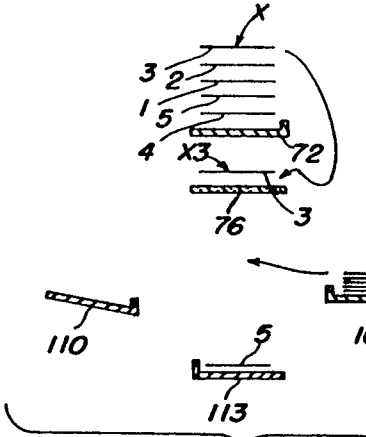
Figure 5:
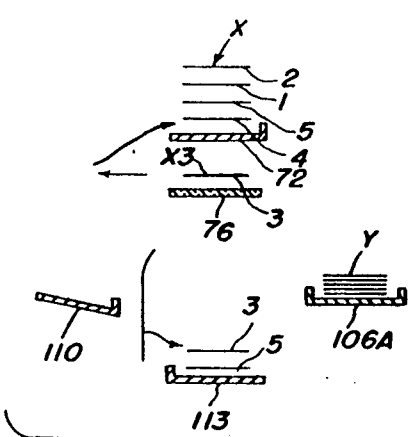
Figure 5:
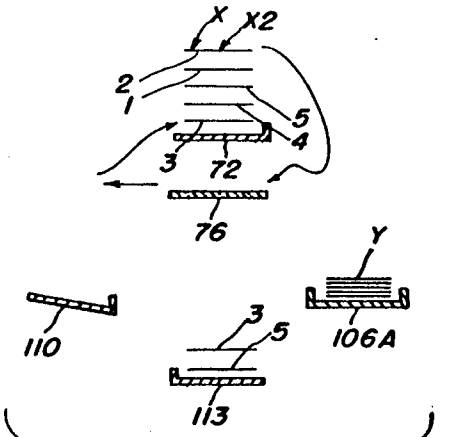
Figure 5:
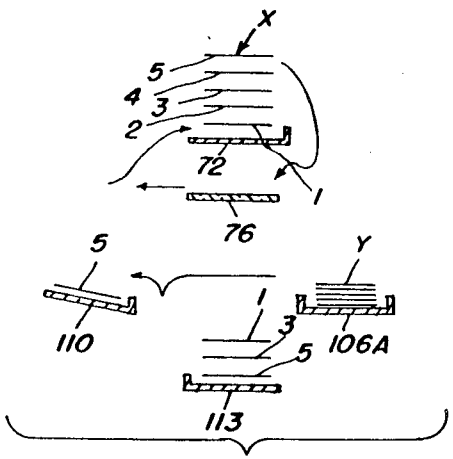
Figure 5:
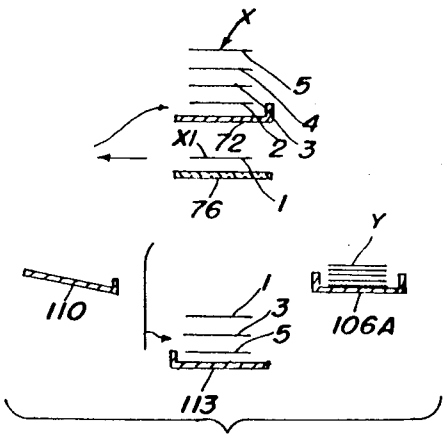
Figure 5:
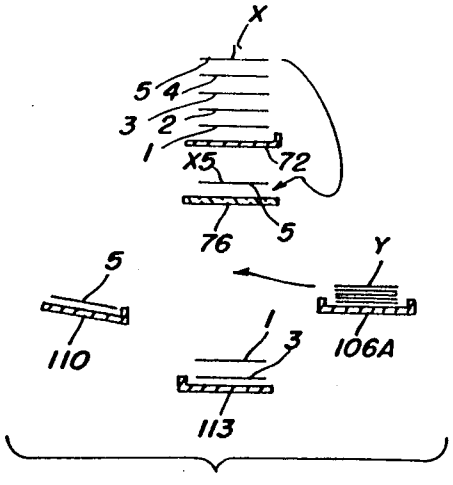
Figure 5:
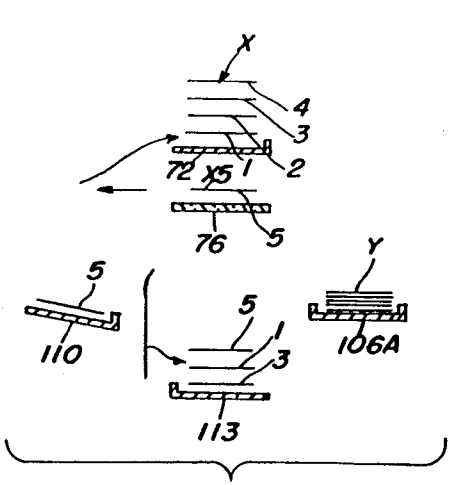
Figure 5:
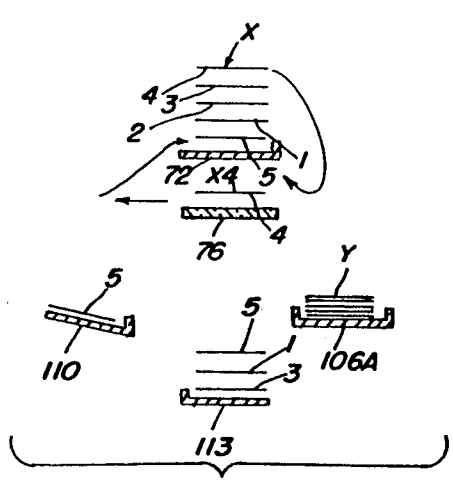
Figure 5:
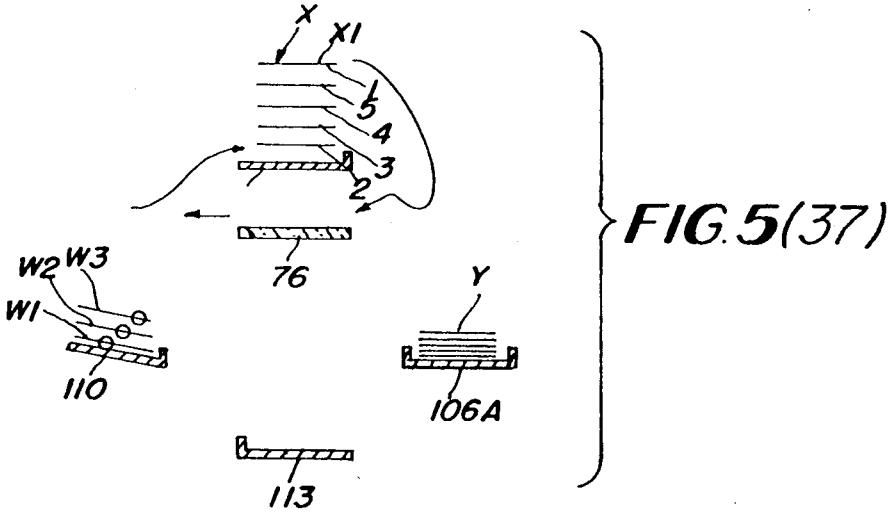
Figure 5:
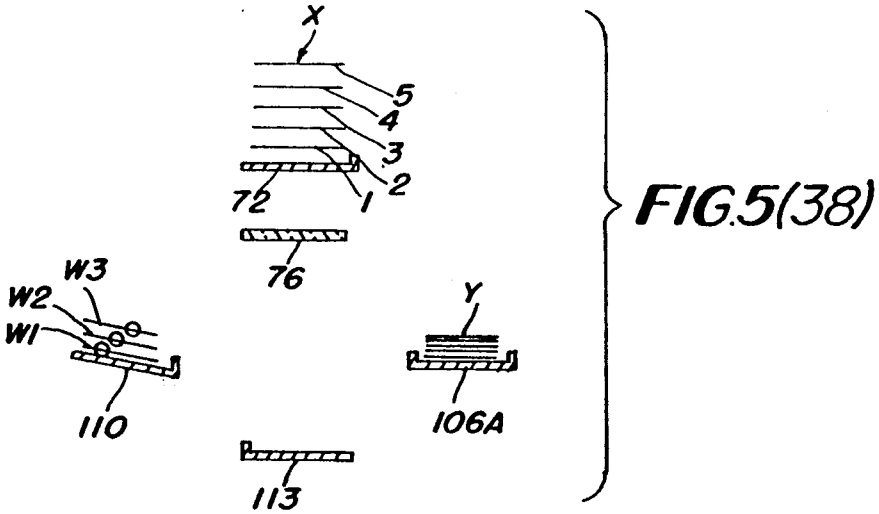

FIG. 5 is a simplified sectional view for explaining the first embodiment of the invention. In this explanation, the number of documents is supposed to be odd (5 documents in this embodiment), and three sets of duplex copies are taken. In the following description, numeral subscripts 1 to 5 denote the page numbers of the simplex documents X. For example, the first page of the documents is indicated as X1. In the drawing, the numerals to indicate the page numbers are shown on the surface of the documents X and copying papers Y.

The simplex documents X are, as shown in FIG. 5 (1), stacked up on the original hopper 72 in the page sequence from bottom to top, with the original side to be copied down. When copying is started, as shown in FIG. 5 (1), the document X5 on the top is presented to the second exposure region 76. From the paper tray 106A, a copying paper Y is supplied, and the document X5 is copied on one side of this copying paper Y. After this copying operation, the documents X5 is returned to the bottom of the original hopper 72 with the original surface down as shown in FIG. 5 (2), and the copying paper is stored in the intermediate tray 113 with the copy side up. In succession, as shown in FIG. 5 (3), the document X4 is presented to the second exposure region 76, but it is not exposed at this time, and is fed and directly returned to the bottom of the original hopper 72. Next, when the document X3 is presented to the second exposure region 76, the same operation as in the case of the document X5 is effected as shown in FIG. 5 (4), (5), and in the case of the document X2, the same operation as in the case of the document X4 is effected as shown in FIG. 5 (6). When the document X1 is presented to the second exposure region 76, as shown in FIG. 5 (7), (8), the same operation as in the case of the document X5 is carried out. Therefore, after the first circulation of the documents, the copying papers Y having the odd-numbered pages of the documents X copied on one side thereof are stored in the intermediate tray 113. That is, copying of odd-numbered pages of the first one of duplex copies W1 is carried out.

Since the document X1 is the final document, it is found that the number of documents is odd at this moment, and thereafter copying is done in the odd-number original mode. First, since the number of documents is odd, it is not necessary to copy the document on the other side of the copying paper Y on which the document X5 is copied, this copying paper Y is copied a blank page on the other side or is only fed blank, and is inverted and discharged into the discharge tray 110 as shown in FIG. 5 (9). Afterwards, the second circulation of the documents X is started.

When the document X5 is supplied, as shown in FIG. 5 (10), (11), similar to the case of the first circulation, a new copying paper Y is supplied from the paper tray 106A, and is stored in the intermediate tray 113. When the document X4 is supplied, as shown in FIG. 5 (12), the copying paper Y stored in the bottom of the intermediate tray 113 (the copying paper on which the document X3 is copied) is supplied, and the document X4 is copied on its other side, and the copying paper is inverted and discharged into the discharge tray 110 as shown in FIG. 5 (13). In the odd-number original mode, in this way, the copying paper supplied from the intermediate tray 113 is inverted, and discharged into the discharge tray 110. As a result, the duplex copies are stacked up as being collated in page sequence on the discharge tray 110, and it is not necessary to collage the copying papers Y after copying.

When the document X3 is supplied, as shown in FIG. 5 (14), (15), a new copying paper Y is supplied, and the copying paper Y after copying is stored in the intermediate tray 113. When the document X2 is supplied, as shown in FIG. 5 (16), the copying paper Y stored in the bottom of the intermediate tray 113 (the copying paper on which the document X1 is copied) is supplied, and the document X2 is copied on its other side, and the copying paper is then inverted and discharged into the discharge tray 110 as shown in FIG. 5 (17). When the document X1 is supplied, as shown in FIG. 5 (18), (19), a new copying paper Y is supplied, and the copying paper Y after copying is stored in the intermediate tray 113. At this moment, the second document circulation is over. In the discharge tray 110, the first set of duplex copies W1 is completed, and in the intermediate tray 113, the copying papers Y having odd-numbered pages copied on one side thereof are stacked up, same as the end of the first document circulation.

In the third document circulation shown in FIG. 5 (20) to (30), the operation is the same as in the second circulation. As shown in FIG. 5 (30), at the end of the third document circulation, the second set of duplex copies W2 is completed in the discharge tray 110, and the copying papers Y having the odd-numbered pages copies on one side thereof are stacked up on the intermediate tray 113.

The operation of the fourth document circulation is explained below. As shown in FIG. 5 (31), the copying paper Y on which the document X5 is copied is inverted and discharged into the discharge tray 110. Since it is not necessary to copy the document X5, it is fed blank and is returned to the original hopper 72. As shown in FIG. 5 (32), (33), when the document X4 is supplied, the copying paper Y on which the document X3 is copied is supplied from the intermediate tray 113, and the document X4 is copied on the other side, and this copying paper Y is inverted and discharged in the discharge tray 110.

The document X3 is fed blank as shown in FIG. 5 (34). When the document X2 is supplied, as shown in FIG. 5 (35), (36), the copying paper Y on which the document X1 is copied is supplied from the intermediate tray 113, and the document X2 is copied on the other side thereof, and this copying paper is inverted and discharged into the discharge tray 110. The document X1 is fed blank as shown in FIG. 5 (37), and the fourth document circulation is over. As shown in FIG.5 (38), the documents X are in the initially stacked state, and three sets of duplex copies W1, W3 are completed in the discharge tray 110.

Figure 6:
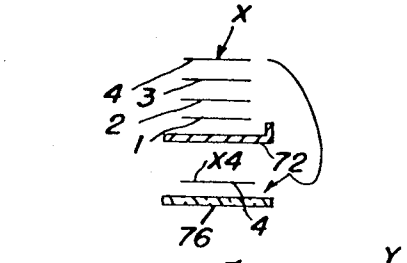
FIG. 6 is a simplified sectional view for explaining the copying action for obtaining duplex copies from an even number of simplex documents in the copying apparatus 77.
Figure 6:
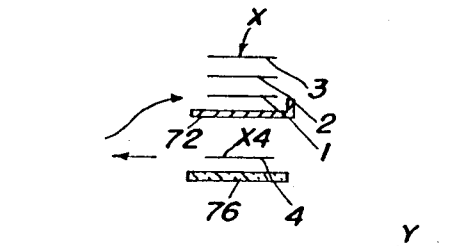
Figure 6:
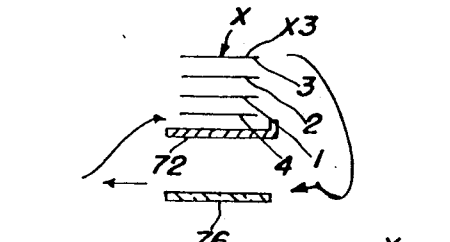
Figure 6:
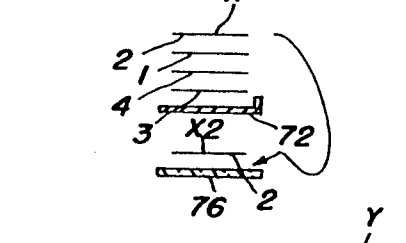
Figure 6:
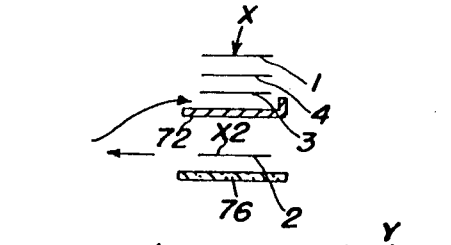
Figure 6:
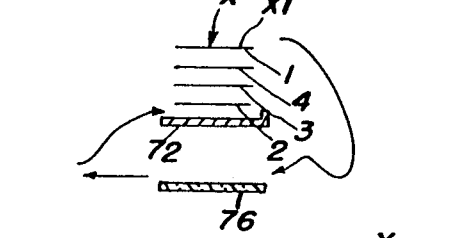
Figure 6:
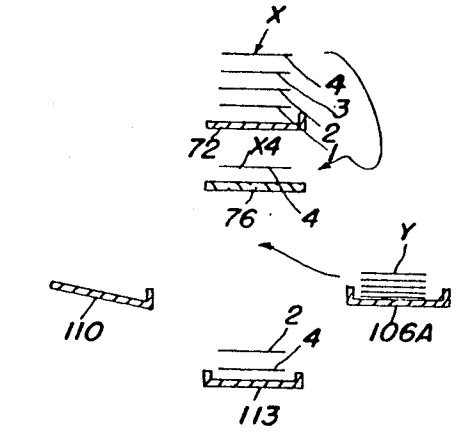
Figure 6:
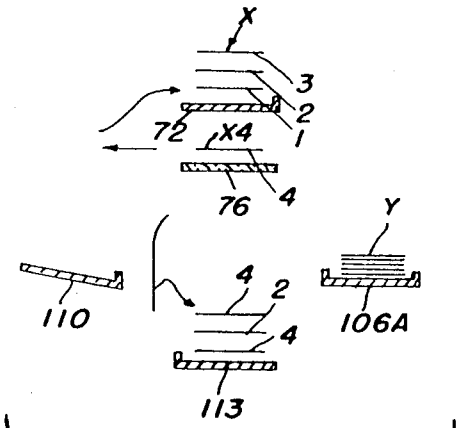
Figure 6:
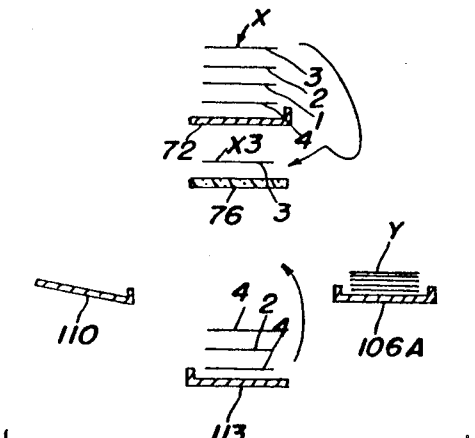
Figure 6:
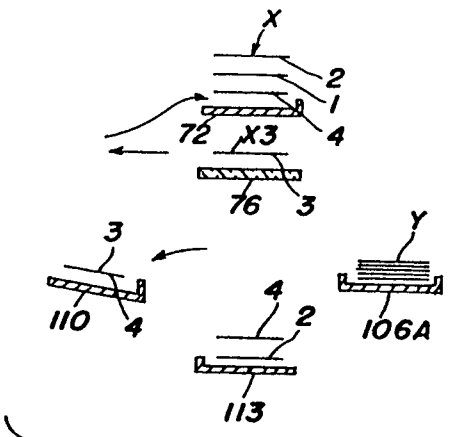
Figure 6:
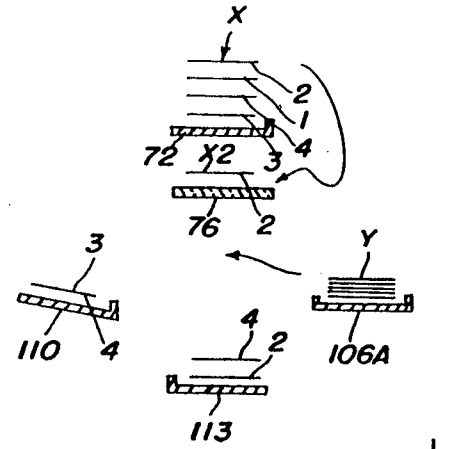
Figure 6:
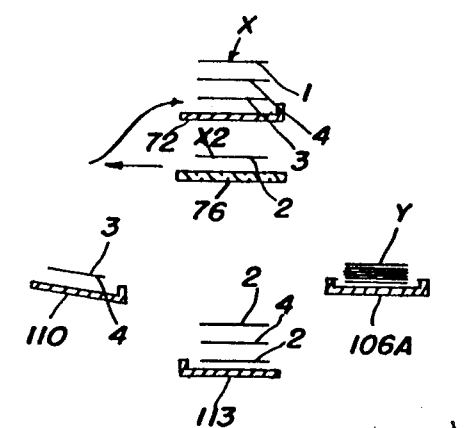
Figure 6:
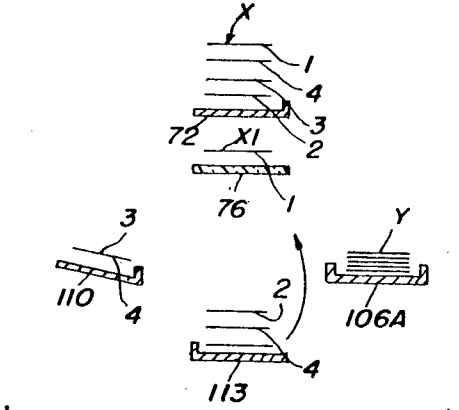
Figure 6:
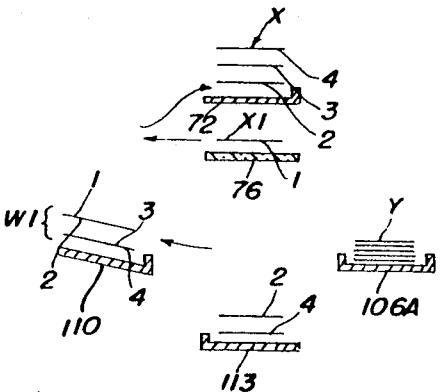
Figure 6:
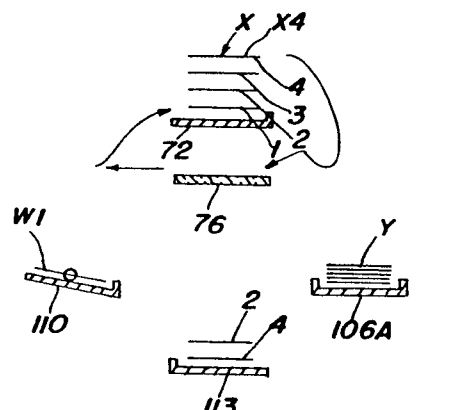
Figure 6:
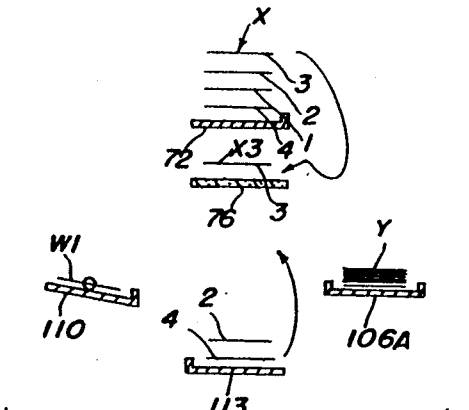
Figure 6:
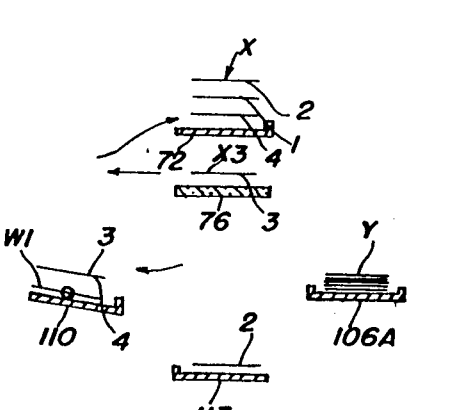
Figure 6:
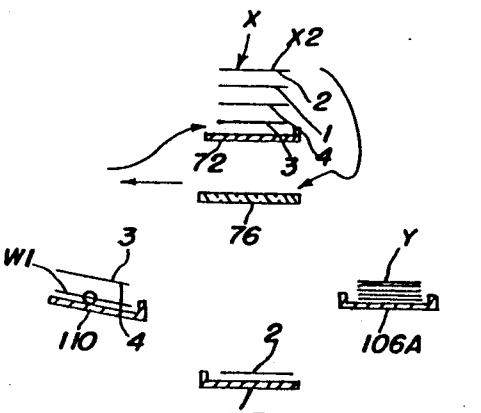
Figure 6:
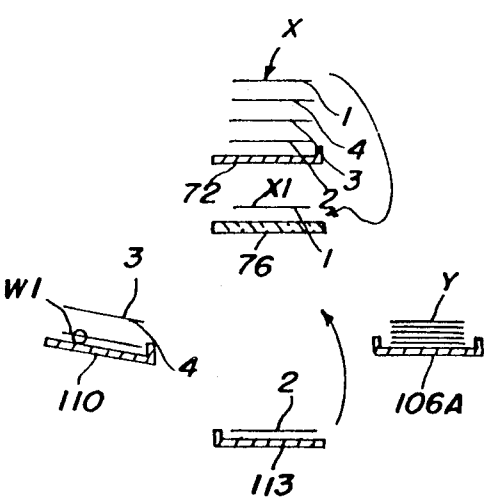
Figure 6:
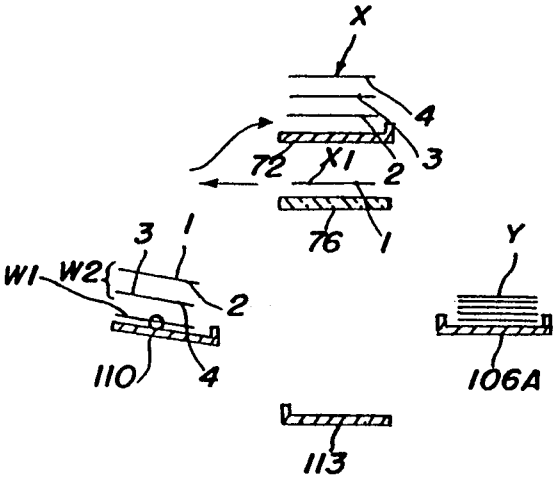

FIG. 6 is a simplified sectional view for explaining also the first embodiment of the invention. In this explanation, the number of documents is supposed to be even (4 documents in this embodiment), and two sets of duplex copies are made.

Simplex documents X are stacked up on the original hopper 72 in the page sequence from bottom to top, with the original surface to be copied down. When copying is started, as shown in FIG. 6 (1), the document X4 on the top is presented to the second exposure region 76. A copying paper Y is supplied from the paper feed tray 106A. The document X4 is copied on one side of this copying paper Y. After copying, as shown in FIG. 6 (2), the document X4 is returned to the bottom of the original hopper 72 with the original side down, and the copying paper is stored in the intermediate tray 113. In succession, as shown in FIG. 6 (3), the document X3 is presented to the second exposure region 76, but it is not exposed but is fed blank and is returned to the bottom of the original hopper 72. Next, when the document X2 is presented to the second exposure region 76, the same operation as in the case of the document X4 is effected as shown in FIG. 6 (4), (5), and in the case of the document X1, the same operation as in the case of the document X3 is carried out as shown in FIG. 6 (6). Since the document X1 is the final document, it is known at this moment that the number of documents is even, and thereafter the copying operation is conducted in the even-number original mode.

Since the number of documents is even, the document X3 must be copied on the other side of the copying paper Y on which the document X4 is copied on one side.

When the document X4 is supplied, as shown in FIG. 6 (7), (8), a new copying paper Y is supplied form the paper feed tray 106A similar to the first document circulation, and is copied, and stored in the intermediate tray 113. When the document X3 is supplied, as shown in FIG. 6 (9), the copying paper Y stored in the bottom of the intermediate tray 113 (the copying paper on which the document X4 is copied) is supplied, and the document X3 is copied on the other side, and the copying paper discharged into the discharge tray 110 while maintaining the face-back relation as shown in FIG. 6 (10). Thus, in the even-number original mode, the copying paper Y supplied from the intermediate tray 113 is discharged into the discharge tray 110 directly, without being inverted. As a result, the duplex copies collated in the page sequence are stacked up on the discharge tray 110, and it is not necessary to collate the copying papers Y after copying.

When the document X2 is supplied as shown in FIG. 6 (11), (12), a new copying paper Y is supplied, and is copied, and stored in the intermediate tray 113. When the document X1 is supplied, as shown in FIG. 6 (13), the copying paper Y stored in the bottom of the intermediate tray (the copying paper on which the document X2 is copied) is supplied, and the document X1 is copied on the other side thereof, and the copying paper is discharged into the discharge tray 110, while maintaining the face-back relation as shown in FIG. 5 (14). At this moment, the second document circulation is over. On the discharge tray 110, a first set of duplex copies W1 is completed, and in the intermediate tray 110, the copying papers Y having the even-numbered originals copied on one side are stacked up same as the end of the first document circulation.

The operation in the third document circulation is explained below. As shown in FIG. 6 (15), when the document X4 is supplied, it is not necessary to copy the document X4, and it is fed blank and returned to the original hopper 72. As shown in FIG. 6 (16), (17), when the document X3 is supplied, the copying paper Y on which the document X4 is copied is supplied from the intermediate tray 113, and the document X3 is copied on the other side thereof, and the copying paper is discharged into the discharge tray 110 while maintaining the face-back relation.

The document X2 is, as shown in FIG. 6 (18), fed blank. When the document X1 is fed, as shown in FIG. 6 (19), (20), the copying paper Y on which the document X2 is copied is supplied from the intermediate tray 113, and the document X1 is copied on the other side thereof, and the copying paper Y is discharged into the discharge tray 110, while maintaining the face-back relation, and thus the third document circulation is over. As shown in FIG. 6 (20), the document X are in the initially stacked state, and two sets of duplex copies W1, S2 are completed on the discharge tray 110.

Thus, according to the first embodiment, it is not needed to count the number of documents X by the RADF 71 before copying the documents X, and the time required for making duplex copies is shortened, and damage of the originals is also reduced.

Figure 7:
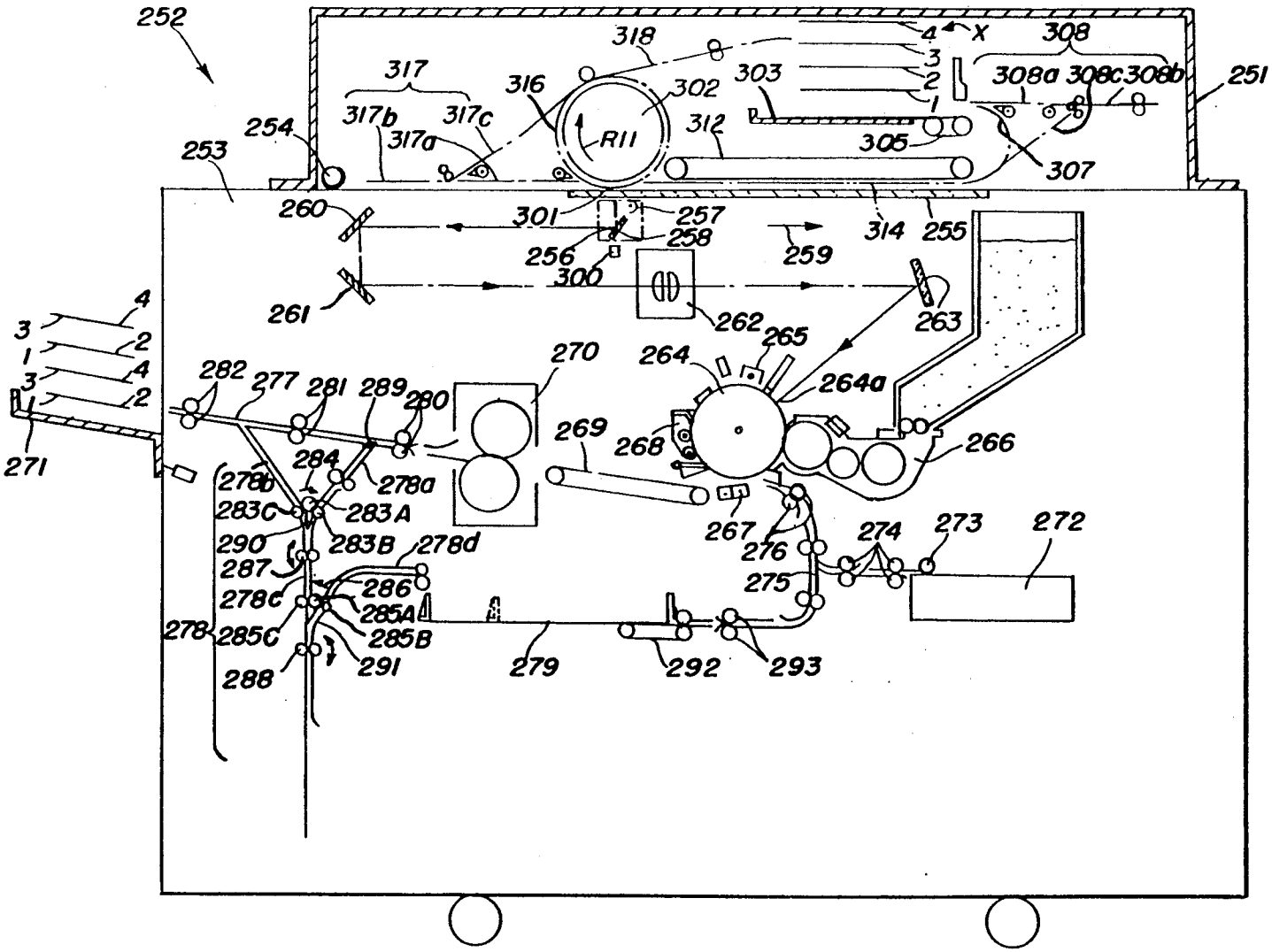
FIG. 7 is a sectional view showing a basic structure of other copying apparatus 252.

FIG. 7 is a sectional view showing a basic structure of an electrostatic copying apparatus 252 comprising RADF 251.

The RADF 251 is mounted on the top of the copying apparatus main body 253 angularly dislocatably with respect to a rotary shaft 254. On the top of the copying apparatus main body 253, there is an original platen 255 made of hard glass or similar material. When the original document X is not fed by the RADF 251 (for example, when the original document X is a book), the document X is put on the original platen 255 with the copy side down, and the document X is pressed and fixed against the original platen 255 beneath the RADF 251, and the copying operation is done in this state.

Inside the copying apparatus main body 253, exposure means 256 is provided so as to be conveyed in the range of the installation of the original platen 255 at a position close to the original platen 255, extending in the direction perpendicular to the sheet of paper in FIG. 7. The exposure means 256 contains a copy lamp 257 realized by halogen lamp or the like, and a reflector 258. The exposure means 256 is conveyed by a mechanism not shown in the draiwng in the direction of arrow 259 when scanning the document X in the state of the document X being stopped on the original platen 255, and the original plane is scanned and exposed in this state.

The light generated from the copy lamp 257 is selectively absorbed in response to the original image on the original plane. The reflected light from the original plane is led into an exposure region 264*a* of a right cylindrical photosensitive drum 264 having an axial line parallel to the longitudinal direction of the exposure means 256, being located near the middle of the inside of the copying apparatus main body 253, by means of reflectors 260, 261, zoom lens 262, and reflector 263, from the reflector 258. When the exposure means 256 is conveyed, the reflectors 260, 261 are also conveyed at the same time, and the length of the optical path from the exposure means 256 up to the exposure region 264*a* of the photosensitive drum 264 is kept constant.

The surface of the photosensitive drum 264 before exposure at the photosensitive drum 264 is uniformly charged by a corona discharger for charging 265 disposed along the outer circumference of the photosensitive drum 264, being extended in the axial direction of the photosensitive drum 264. When the surface of such photosensitive drum 264 is illuminated with the reflected light from the original plane as mentioned above, the surface of the photosensitive 264 is selectively destaticized, and an electrostatic image is formed in this way. This electrostatic image is made sensible into a toner image by a developing apparatus 266, and this toner image is transferred onto the copying paper after being conveyed by the structure described later near the transfer region 264*b* by the function of the corona discharger for transfer 267.

The toner remaining on the surface of the photosensitive 264 after transfer of the toner image is removed by a cleaning apparatus 268. The copying paper after transfer of the toner image is led into a fixing apparatus 270 by means of conveying belt 269, and the toner image is heated and fixed by this fixing apparatus 270. The copying paper passing through the copying process in this way is discharged onto a paper discharge tray 271 installed at one side of the copying apparatus main body 253 in the manner described below.

In the copying apparatus main body 252, a paper feed cassette 272 containing plural copying papers is installed. The copying papers contained in the paper feed cassette 272 are taken out one by one by a paper feed roller 273 which is rotated and driven in a state being pressed against the top sheet of the stack of copying papers, and are sent into the paper feed route 275 by means of conveying roller 274. Near the transfer region 264*b* of the paper feed route 275, a pair of resist rollers 276 are provided, and these resist rollers 276 are coupled to the drive shaft of drive means which is not shown inside the copying apparatus main body 253 by way of a clutch not shown. By the on/off control of the clutch, the copying paper can be transferred in synchronism with the toner image formed on the surface of the photosensitive drum 264.

Branching off from the discharge route 277 leading to the paper discharge tray 271 from the outlet of the fixing apparatus 270, an inverting route 278 is provided. This inverting route 278 is composed of first and second route 278*a*, 278*b* branching off at mutually different positions from the upstream side of the conveying direction of the copying paper of the discharge route 277, a third route 278*c* extending downward from the converging part of the first and second routes 278*a*, 278*b*, and a fourth route 278*d* branching off from the third route 278*c* and reaching up to an intermediate tray 279. In relation to the discharge route 277, pairs of conveying rollers 280, 281, 282 are disposed at a spacing.

In the inverting route 278, in relation to the converging position of the first and second routes 278*a*, 278*b*, a roller 283A is disposed, and rollers 283B, 283C commonly connected to this roller 283A are disposed in relation to the first and second routes 278*a*, 278*b*, respectively. The roller 283A is rotated and driven in the direction of arrow 284, which makes it possible to convey the copying paper from the first route 278*a* to the third route 278*c*, and from the third route 278*c* to the second route 278*b*. Moreover, in relation to the position of branching of the fourth route 278*d* from the third route 278*c*, a roller 285A is disposed, and rollers 285B, 285C commonly contacting with the roller 285A are disposed in relation to the fourth and third routes 278*d*, 278*c*, respectively. The roller 285A is rotated and driven in the direction of arrow 286, which makes it possible to convey the copying paper in the direction perpendicularly downward near the roller 285C, and also to convey in the direction toward the intermediate tray 279 inside the fourth route 278*d*.

At the third route 278*c* near the converging position of the first and second routes 278*a*, 278*b*, a conveying roller 287 rotating in normal and reverse directions is disposed, and another conveying roller 288 rotating in normal and reverse directions is disposed in the third route 278*c* at the lower side of the position near the branching position of the fourth route 278*d* from the third route 278*c*. Furthermore, near the branching position of the first route 278*a* from the discharge route 277, a gate flapper 289 for selectively leading the copying paper from the fixing apparatus 270 to the discharge route 277 or first route 278*a* is disposed, and at the converging position of the first and second routes 278*a*, 278*b*, a gate flapper 290 for securely leading the copying paper from the third route 278*c* to the second route 278*b* is disposed, and at the branching position of the fourth route 278*d* from the third route 278*c*, a gate flapper 291 for securely leading the copying paper from the third route 278*c* to the fourth route 278*d* is disposed.

The copying paper stacked on the intermediate tray 279 has a copy image formed on its upper side. Such copying paper is taken out one by one a paper feed belt 292 from the stack of recording papers placed at the bottom side, and is led into the paper feed route 275 by means of conveying roller.

The copying paper from the fixing apparatus 270 is able to be discharged in the following three manners.

1. To be discharged directly onto the paper discharge tray 271 by way of the discharge route 277.

2. To be led into the discharge route 277 again from the discharge route 277 through the first route 278*a*, third route 278*c*, and second route 278*b*, so as to be inverted, and discharged onto the paper discharge tray 271.

3. To be once stacked up on the intermediate tray 279 from the discharge route 277 through the first route 278*a*, third route 278*c*, and fourth route 278*a*, and led to the vicinity of the transfer region 264*b* of the photosensitive drum 264 through the paper feed route 275, and passed again through the fixing apparatus 270, and led into the discharge route 277 again from the discharge route 277 through the first route 278*d*, third route 278*c*, and second route 278*b*, and discharged onto the discharge tray 271.

Such discharge modes 1 to 3 of the copying paper are selected corresponding to the copy mode entered by the operator form the operation unit, not shown, installed in the copying apparatus main body 253. Plural detectors (not shown) are disposed at proper positions in the conveying route of the copying paper in the copying apparatus main body 253, and by detecting the copying paper by these detectors, the conveying rollers and gate flappers are driven, thereby realizing the conveying modes of the copying paper as described above.

Figure 8:
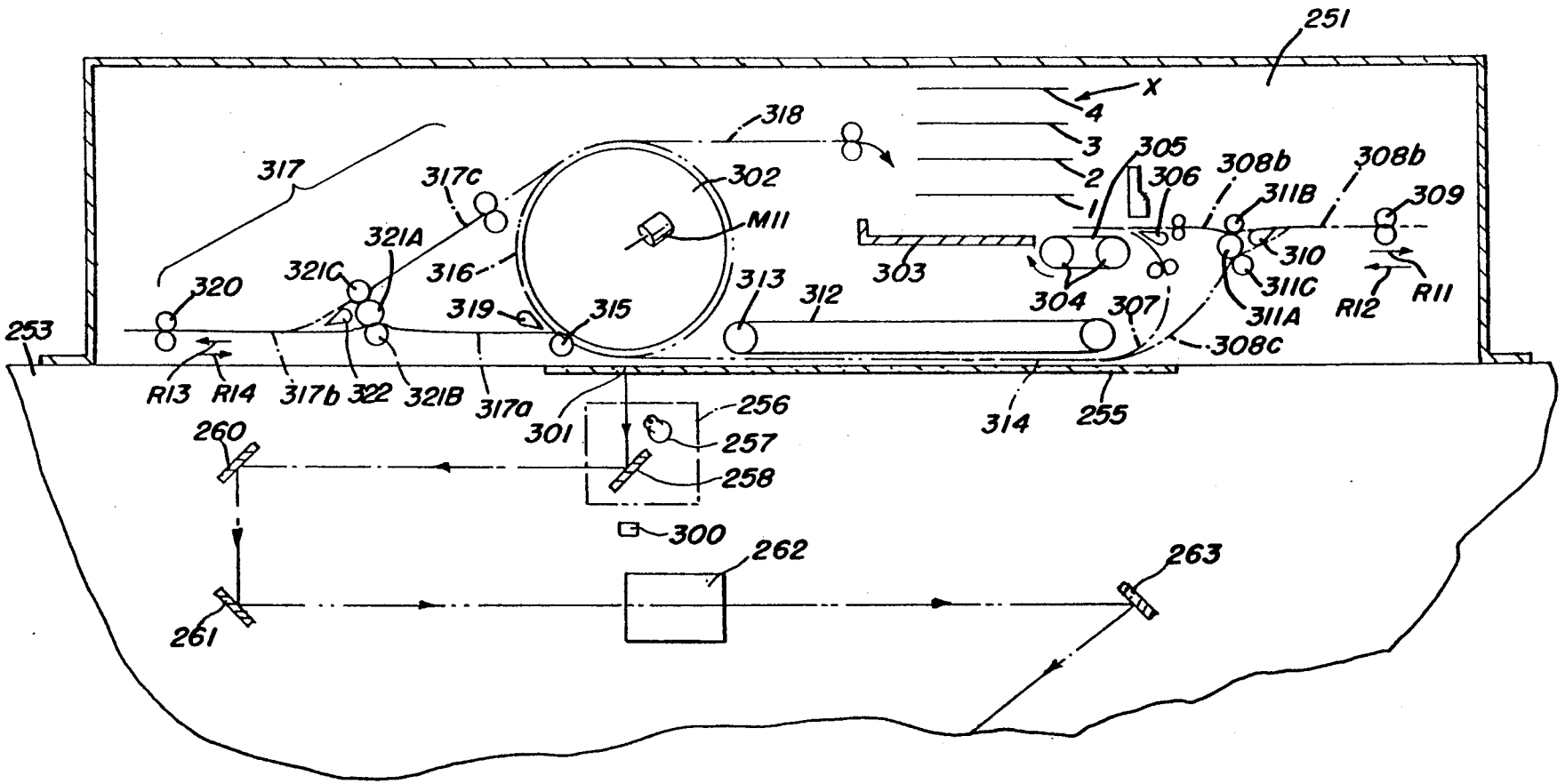
FIG. 8 is a sectional view showing a basic structure of other RADF 251.

FIG. 8 is an enlarged sectional view of the structure of the RADF 251. When copying by using this RADF 251 while conveying the sheet originals, the exposure means 256 is detected by a sensor 300, and the exposure means 256 is stopped at a position relating to the exposure region 301 commonly shown in FIGS. 7 and 8. In the RADF 251 at a position corresponding to the upper side of the exposure region 301, an original drum 302 of right cylindrical shape possessing an axial line vertical to the sheet of paper in FIGS. 7 and 8 is provided. This original drum 302 is rotated and driven in the direction of arrow R11 by a motor M11.

In the RADF 251, a plurality of sheet documents X are put on the original hopper 303 which is an original storing means. Relating to the original hopper 303, there is a paper feed belt 305 which is the feeding means wound on a driving roller 304 being rotated and driven in the direction of arrow as the torque of the motor M11 is transmitted through the clutch. By the paper feed belt 305, the bottom side sheet original in the original hopper 303 of the plurality of sheet documents X is drawn out.

The drawn sheet documents X is selectively led into the first conveying route 307 which is a first inverting means or second conveying route 308 which is a first conveying means by means of a gate flapper 306 driven by the solenoid. That is, while the solenoid is de-excited, the gate flapper 306 closes the second conveying route 308, and opens the first conveying route 307. When the solenoid is excited, the gate flapper 306 is angularly dislocated, and the first conveying route 307 is closed, while the second conveying route is opened.

The first conveying route 307 extends in the widthwise direction of the sheet documents X (in the direction vertical to the sheet of paper in FIGS. 7 and 8), and there is a semicircumferential-shaped section vertical to the longitudinal direction, and the sheet documents X drawn out by the paper feed belt 305 are led into the vicinity of the original platen 255.

The second conveying route 308 comprises a first route 308*a* extending in the horizontal direction from the original hopper 303, a second route 308*b* continuous with this first route 308*a*, and a third route 308*c* converging with the first route 308*a* near the original platen 255, branching off from the second route 308*b*. In the second route 308*b*, there is a conveying roller 309 which is driven and rotated in normal and reverse directions as the torque of the motor M11 is transmitted, so that the sheet documents X are conveyed in the direction of arrows R11, R12 in the second route 308*b*.

Relating to the position where the third route 308*c* is branched off from the second route 308*b*, there is a gate flapper 310 for leading the sheet documents X led into the second route 308 securely into the third route 308*c*. Relating to this position, moreover, a roller 311A is disposed, and rollers 311B, 311C commonly contacting with the roller 311A are disposed in relation to the first and third routes 308*a*, 308*c*, respectively. While the solenoid is de-excited, the line between the first route 308*a* and second route 308*b* is released, and when it is excited, the gate flapper 310 is angularly dislocated, and the line between the first and second routes 308*a*, 308*b* is closed, while the line between the second and third routes 308*b*, 308*c* is widely opened.

The sheet documents X led into the vicinity of the original platen 255 from the first conveying route 307 or the third route 308*c* of the second conveying route 308 are conveyed in the conveying route 314 formed between the conveying belt 312 and the original platen 255, by means of the conveying belt 312 disposed in relation to the original platen 255. This conveying belt 312 is wound on a driving roller 313 to which is transmitted the torque of the motor M11 through an unshown structure.

The sheet documents X led to the vicinity of the exposure region 301 by the conveying belt 312 is held between the original drum 302 and the driven roller 315 contacting with the original drum 302, and is conveying as being wound on the original drum 302.

Near the driven roller 315, the conveying route of the sheet document X is branched off into the third conveying route 316 which is a second inverting means and fourth conveying route 317 which is a second conveying means. The third conveying route 316 is the way along the outer circumference of the exposure drum 302, and is continuous to the conveying route 318 consecutive to the upper side of the original hopper 303.

The fourth conveying route 317 is composed of a first route 317*a* branched off in the horizontal direction near the driven roller 315 from the third conveying route 316, a second route 317*b* extending continuously with the first route 317*a*, and a third route 317*c* branching off from the second route 317*b*, converging with the third conveying route 316, and continuous with the conveying route 318. At the position where the first route 317*a* is branched off the third conveying route 316, there is a gate flapper 319 which is driven by solenoid to selectively lead the sheet documents X led in from the exposure region 301 into the fourth conveying route 316 or third conveying route 317 depending on excitation or de-excitation of the solenoid. In the second route 317*b*, there is a conveying roller 320 which is rotated as the torque of the motor M11 is transmitted through clutch, so that the sheet documents X in the second route 317*b* are conveying in the direction of arrows R13, R14.

Relating to the position where the third route 317*c* is branched off the second route 317*b*, a driving roller 321A is disposed, and rollers 321B, 321C commonly contacting with the driving roller 321A are disposed in relation to the first and third routes 317*a*, 317*c*, respectively. At the branching part, moreover, a gate flapper 322 which is driven by a solenoid is installed, so that the sheet documents X may be securely led in from the second route 317*b* into the third route 317*c*. While the solenoid is de-excited, the line between the first and second routes 317*a*, 317*b* is opened, and when the solenoid is excited, the gate flapper 322 is angularly dislocated, and the line between the first and second routes 317*a*, 317*b* is closed, while the line between the second and third routes 317*b*, 317*c* is widely opened.

Figure 9:
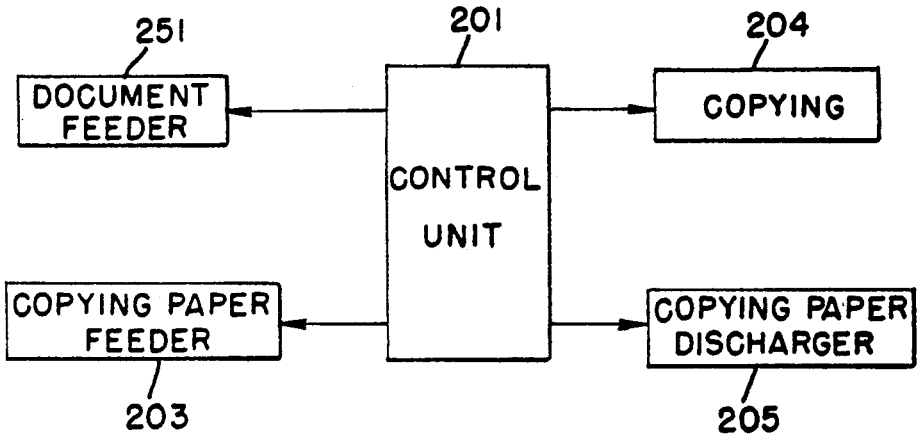
FIG. 9 is a block diagram showing an electric composition of the copying apparatus 252, FIGS. 10(1)-10(18) are is a simplified sectional views for explaining the copying action for obtaining duplex copies from an odd number of simplex documents in the copying apparatus 252.

FIG. 9 is a block diagram showing a basic electrical structure of the copying apparatus 252. A control unit 201 controls a document feeder 251, copying paper feeder 203, copying means 204, and copying paper discharger 205.

The copying paper feeder 203 comprises paper feed tray 272 and intermediate tray 279, and the copying paper discharger 205 comprises discharge tray 271, discharge route 277, and inverting route 278. The copying means 204 comprises exposure means 256 and photoreceptor 264, among others.

FIG. 10 is a simplified sectional view showing the second embodiment of the invention. The simplex documents X are stacked up on the original hopper 303 in the page sequence from bottom to top, with the original surface to be copied down. The documents X are fed one by one sequentially from the bottom, and returned to the top. In the following explanation, the number of documents is supposed to be odd (3 documents in this embodiment), and three sets of copies are made.

The document X1 is fed into the exposure region 301 through the second conveying route 308 as shown in FIG. 10 (1). A copying paper Y is fed from the paper feed tray 272, and the document X1 is copied on one side of the copying paper Y. The document X1 after being copied is returned to the original hopper 303 by way of the third conveying route 316 as shown in FIG. 10 (2), and the copying paper Y is stored in the intermediate tray 279. The document X2 is fed into the exposure region 301 through the second conveying region 308 as shown in FIG. 10 (3). The copying paper Y on which the document X1 is copied is supplied from the intermediate tray 279, and the document X2 is copied on the other side of the copying paper Y. As shown in FIG. 10 (4), the document X2 after being copied is returned to the original hopper 303 through the third conveying route 316, and the copying paper Y is directly discharged into the discharge tray 271 without changing the face-back relation.

The document X3 is supplied into the exposure region 301 through the second conveying route 308 as shown in FIG. 10 (5), and the document X3 is copied on one side of the copying paper Y supplied from the paper feed tray 272. At this point, the document X3 is judged to be the final page, and the copying paper Y is inverted as shown in FIG. 10 (6) and is discharged into the discharge tray 271. Therefore, at the end of the first document circulation, the first set of duplex copies W1 is completed, and the documents X are stacked up in the inverted face-back relation as being initially stacked up on the original hopper 303.

The second document circulation is described below. The documents X are stacked up on the original hopper 303 with the original surface up, and are fed into the exposure region 301 through the first conveying route 307, and are returned to the original hopper 303 by way of the third conveying route 316. The copying action is same as in the first document circulation as shown in FIG. 10 (7) to (12). Therefore, at the end of the second document circulation, the second set of duplex copies W2 is completed, and the documents X are stacked up in the inverted face-back relation as initially stacked up on the original hopper 303.

In the third document circulation, the documents X are presented to the exposure region 301 through the first conveying means 307, and are returned to the original hopper 303 by way of the fourth conveying route 317. The copying action is same as in the first document circulation as shown in FIG. 10 (13) to (18). Therefore, at the end of the third document circulation, three sets of duplex copies W1 to W3 are finished, and the documents X are returned to the same state as initially stacked up on the original hopper 303.

Figure 11:
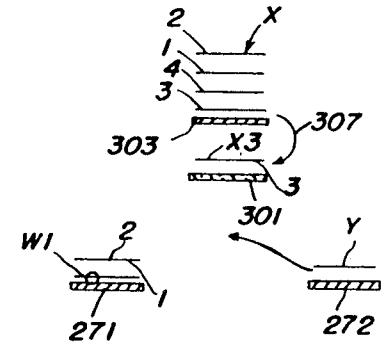
FIGS. 11(1)-11(24) are is a simplified sectional views for explaining the copying action for obtaining duplex copies from an even number of simplex documents in the copying apparatus 252.
Figure 11:
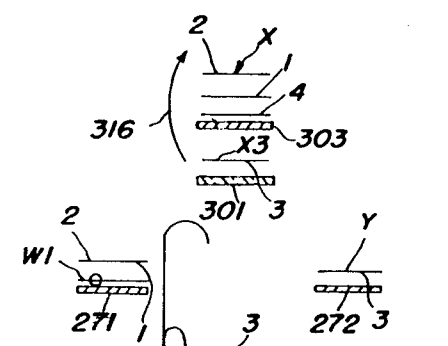
Figure 11:
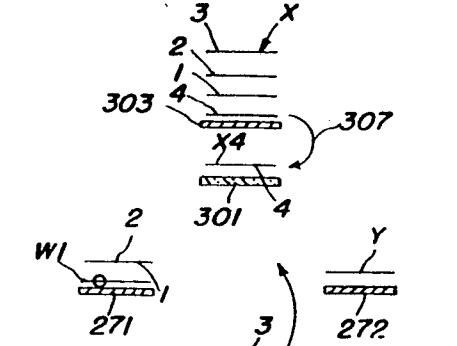
Figure 11:
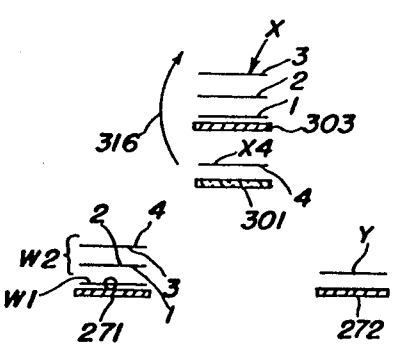
Figure 11:
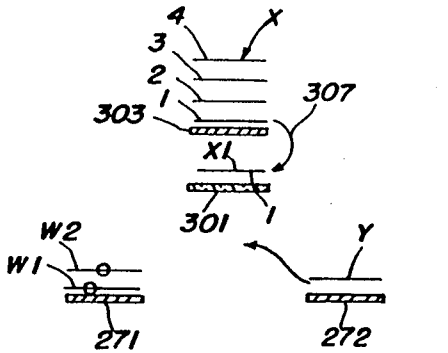
Figure 11:
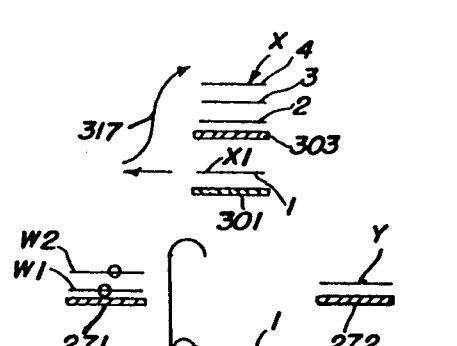

FIG. 11 is a simplified sectional view also explaining the second embodiment of the invention. The simplex documents X are stacked up on the original hopper 303 in the page sequence from bottom to top, with the original surface to be copied down. The documents X are sequentially fed one by one from the bottom, and are returned to the top. In this explanation, the number of documents X is supposed to be even (4 documents in this embodiment), and three sets of copies are made.

The document X1 is fed into the exposure region 301 through the second conveying route 308 as shown in FIG. 11 (1). A copying paper Y is fed from the paper feed tray 272, and the document X1 is copied to one side of the copying paper Y. The document X1 after being copied is returned to the original hopper 303 through the third conveying route 316 as shown in FIG. 11 (2), and the copying paper Y is stored in the intermediate tray 279. The document X2 is fed into the exposure region 301 through the second conveying route 308 as shown in FIG. 11 (3). The copying paper Y on which the document X1 is copied is supplied from the intermediate tray 279, and the document X2 is copied on the other side of the copying paper Y. As shown in FIG. 11 (4), the document X2 after being copied is returned to the original hopper 303 through the third conveying route 316, and the copying paper Y is discharged into the discharge tray 271 directly in the same face-back relation.

The document X3 is supplied into the exposure region 301 through the second conveying route 308 as shown in FIG. 11 (5), and is copied on one side of a copying paper Y supplied from the paper feed tray 272. The document X3 after being copied is returned to the original hopper 303 through the third conveying route 316 as shown in FIG. 11 (6), and the copying paper Y is stored in the intermediate tray 279. The document X4 is supplied into the exposure region 301 through the second conveying route 208 as shown in FIG. 11 (7). The copying paper Y on which the document X3 is copied is supplied from the intermediate tray 279, and the document X4 is copied on the other side of the copying paper Y. As shown in FIG. 11 (8), the document X4 after being copied is returned to the original hopper 303 through the third conveying route 316, and the copying paper Y is discharged into the discharge tray 271 directly in the same face-back relation. At this point, the document X4 is judged to be the final page. Therefore, at the end of the first document circulation, the first set of duplex copies W1 is over, and the documents X are stacked up in the inverted face-back relation as initially stacked on the original hopper 303.

The second document circulation is explained below. The documents X are stacked up on the original hopper 303 with the original surface up, and are therefore fed into the exposure region 301 through the first conveying route 307, and are returned to the original hopper 303 by way of the third converying route 316. The copying action is same as in the first document circulation as shown in FIGS. 11 (9) to (17). Therefore, at the end of the second document circulation, the second set of duplex copies W2 is completed, and the documents X are stacked up in the inverted face-back relation as being initially stacked up on the original hopper 303.

In the third document circulation, the documents are presented to the exposure region 301 through the first conveying route 307, and are returned to the original hopper 303 through the fourth conveying route 317. The copying action is same as in the first document circulation as shown in FIG. 11 (17) to (24). Therefore, at the end of the third document circulation, three sets of duplex copies W1 to W3 are finished, and the documents X are returned to the same state as initially stacked up on the original hopper 303.

Thus, according to the second embodiment, without having to count the number of documents X, duplex copies are obtained from simplex documents corrected collated in the page sequence. Moreover, the route for leading the documents X from the original hopper 303 into the exposure region 301, and the route of leading the copied documents X from the exposure region 301 back to the original hopper 303 are different, and the second and fourth conveying routes 308, 317 are used only twice for conveying the documents X while maintaining the face-back relation, and therefore the time required for producing duplex copies may be shortened.

The invention may be embodied in other specific forms without departing from the spirit or essential characteristics thereof. The present embodiments are therefore to be considered in all aspects as illustrative and not restrictive, the scope of the invention being indicated by the appended claims rather than by the foregoing description and all changes which come within the meaning and the range of equivalency of the claims are therefore intended to be embraced therein.

What is claimed is:

1. A copying apparatus for obtaining collated duplex copies from simplex documents comprising:

exposure glass forming a first exposure region, initial means for storing the documents so that the side to be copied comes down piled up in page sequence, means for feeding the documents one by one from the final page on the bottom of the stack in the initial storing means to a second exposure region, means for returning the documents from the second exposure region into the initial storing means, means for copying the document image exposed in the first and second exposure regions into a copying paper, means for temporarily storing the copying papers after copying, means for conveying the copying papers from a copying paper storing means into the copying means, means for discharging copying papers after copying, and means for controlling copying, the means for controlling copying in a case of storing the documents in the initial storing means, the documents being fed every other page from the final page on one side of the copying papers while counting the number of documents in a first session of document feeding, storing the copying paper after copying into copying paper storing means, and, in the second session of document feeding, feeding the copying paper from copying paper storing means, when the number of documents is odd, discharging without copying on the other side of the copying paper on which the final page of the documents is copied, and copying the remaining documents not copied in the first session of document feeding in the reverse page sequence on the other side of the copying papers on which the second page from the final one and after the documents are copied, and, when the number of documents is even, copying the remaining documents not copied in the first session of document feeding in the reverse page sequence on the other side of the copying papers after the final page of the documents, and then discharging them face down to the final storing means, and the means for controlling copying in a case of setting the document at the first exposure region on the exposure glass directly, exposing the document as is without conveying of the document, the copying papers being fed to the means for temporarily storing face down.

2. The copying apparatus according to claim 1, wherein the first exposure region formed by the exposure glass is adjacent the second exposure region and wherein the means for copying comprises a movable exposure means for exposing the document, the exposure means being movable beneath both the first and second exposure regions.

3. the copying apparatus according to claim 2, wherein the exposure means comprises a copy lamp and a reflector and wherein the means for copying further comprises a photoreceptor which receives light from the exposure means and upon which an electrostatic latent image of the document is formed, the photoreceptor being adjacent the means for conveying the copying papers from the copying paper storing means.

4. The copying apparatus according to claim 1, wherein the copying paper storing means comprises a plurality of paper feed trays for copying paper of different sizes and wherein the means for temporarily storing the copying papers comprises an intermediate tray, the intermediate tray having a paper feed roller for discharging the copying papers therefrom.

5. The copying apparatus according to claim 1, wherein the final storing means comprises a discharge tray provided on a side of the copying apparatus, the copying apparatus further comprising means for shifting the discharge tray such that groups of the copying papers can be formed on the discharge tray.

6. The copying apparatus according to claim 1, further comprising a feed route for feeding copying papers from the means for temporarily storing to the means for copying, the feed route being connected to the means for conveying the copying papers from the copying paper storing means.

7. The copying apparatus according to claim 6, further comprising an inverting route for feeding copying papers from the means for discharging copying papers before the copying papers are fed to the final storing means, the inverting route feeding the copying papers to the means for temporarily storing.

8. The copying apparatus according to claim 7, wherein the inverting route comprises first, second, third and fourth inverting routes, the first and second inverting routes being branched at first ends thereof from the means for discharging copying papers at two positions, second ends of the first and second inverting routes leading to a first end of the third inverting route, the third inverting route having a second end and having a branch before this second end, the branch of the third inverting route leading to the fourth inverting which then leads to the means for temporarily storing.

9. The copying apparatus according to claim 8, wherein the means for controlling will control feeding of the copying papers from the means for copying, through the means for discharging, the first inverting route, the third inverting route and the fourth inverting route to the means for temporarily storing such that the copying papers are temporarily stored face up in the means for temporarily storing.

10. The copying apparatus according to claim 9, wherein the means for copying includes a photoreceptor and wherein the means for controlling will control feeding of the copying papers from the means for temporarily storing through the feed route to the means for copying such that a bottom, unexposed side of the copying papers will be fed facing the photoreceptor.

11. The copying apparatus according to claim 9, wherein the means for copying includes a photoreceptor, and wherein the means for controlling will control feeding of the copying papers from the means for copying, through the means for discharging, through the first inverting route, the third inverting route and the second inverting route back to the means for discharging such that a side of the copying papers facing the photoreceptor in the means for copying will be discharged to the final storing means face down.

12. The copying apparatus according to claim 11, wherein the means for controlling will control feeding of the copying papers from the means for copying through the means for discharging to the final storing means without passing the copying papers through the inverting route such that a side of the copying papers facing the photoreceptor in the means for copying will be discharged to the final storing means face up.

13. A copying method for obtaining collated duplex copies from simplex document comprising the steps of:

feeding simplex documents stacked up in the page sequence from bottom to top having the side to be copied at the lower side, one by one from the bottom, exposing with the side to be copied of the fed simplex documents downward in the first copying operation to copy each page of the simplex documents sequentially on both sides of copying paper, and stacking up the simplex documents after being copied with the side to be copied up, and conveying the simplex documents with the side to be copied up so that the side to be copied may be at the lower side, and copying on both sides in second and subsequent operations.

14. A copying apparatus for obtaining collated duplex copies from simplex documents comprising:

means for storing a stack of documents in page sequence from bottom to top, the stack at least initially having each side of the documents to be copied face down;

feeding means for withdrawing documents one by one from the bottom of the stack;

means for exposing the documents on an exposure glass;

first inverting means and first conveying means for moving documents to the exposure glass after the documents are withdrawn from the stack by feeding means, the first inverting means and first conveying means being located downstream of the means for storing and upstream of the exposure glass;

second inverting means and second conveying means for moving documents from the exposure glass to the means for storing, the second inverting means and second conveying means being located downstream of the exposure glass and upstream of the means for storing; and control means for controlling the feeding of documents from the means for storing to the exposure glass and back to the means for storing, the control means leading the document through one of the first inverting means and first conveying means and through one of the second inverting means and second conveying means during each copy operation;

the first inverting means conveying documents face up in the stack to the exposure glass, the first conveying means conveying documents face down in the stack to the exposure glass, the second inverting means conveying documents from the exposure glass to the storing means to be face up in the stack and the second conveying means conveying documents from the exposure glass to the storing means to be face down in the stack.

15. The conveying apparatus according to claim 14, further comprising first and second gate flappers controlled by the control means, the first gate flapper directing the documents to one of the first conveying means and the first inverting means during each copy operation, and the second gate flapper directing the documents to one of the second conveying means and the second inverting means during each copy operation.

16. The copying apparatus according to claim 14, wherein the first inverting means conveys the documents along a curved path from the feeding means to the exposure glass, the documents being inverted when moving through the first inverting means to be in an opposite orientation on the exposure glass than in the storing means.

17. The copying apparatus according to claim 16, wherein the first conveying means comprises a first route, a second route continuous with the first route and a third route from the second route to the exposure glass, the documents being moved through the first route to the second route in a direction and then to the third route in an opposite direction, the documents moved through the first conveying means having a same orientation when on the exposure glass as when in the storing means.

18. The copying apparatus according to claim 14, wherein the first conveying means comprises a first route, a second route continuous with the first route and a third route from the second route to the exposure glass, the documents being moved through the first route to the second route in a direction and then to the third route in an opposite direction, the documents moved through the first conveying means having a same orientation when on the exposure glass as when in the storing means.

19. The copying apparatus according to claim 14, wherein the second inverting means conveys the documents along a curved path from the exposure glass to the storing means, the documents being inverted when moving through the second inverting means to be in an opposite orientation in the storing means than on the exposure glass.

20. The copying apparatus according to claim 19, wherein the second conveying means comprises a first route, a second route continuous with the first route and a third route from the second route to a conveying route leading to the storing means, the documents being moved through the first route to the second route in a direction and then to the third route in an opposite direction, the documents moved through the second conveying means having a same orientation when in the storing means as when on the exposure glass.

21. The copying apparatus according to claim 14, wherein the second conveying means comprises a first route, a second route continuous with the first route and a third route from the second route to a conveying route leading to the storing means, the documents being moved through the first route to the second route in a direction and then to the third route in an opposite direction, the documents moved through the second conveying means having a same orientation when in the storing means as when on the exposure glass.

22. The copying apparatus according to claim 14, further comprising a conveyor belt for conveying the documents over the exposure glass and between one of the first inverting means and the first conveying means to one of the second inverting means and the second conveying means.

23. The copying apparatus according to claim 14, wherein the control means in a first copying operation leads the documents from the storing means through the first conveying means to the exposure glass whereafter the control means leads the documents from the exposure glass through the second inverting means to the storing means whereat the documents are then stored face up.

24. The copying apparatus according to claim 23, wherein after all documents are stored face up in the storing means, the control means leads the documents through the first inverting means to the exposure glass and if more than one copy is to be made, the control means leads the documents from the exposure glass through the second inverting means to the storing means whereat the documents are again stored face up.

25. The copying apparatus according to claim 24, wherein the control means leads documents stored face up in the storing means through the first inverting means to the exposure glass and then through the second conveying means to finally be stored face down in the storing means when a last set of copies is to be made.

26. A copying method for obtaining collated duplex copies from simplex documents comprising the steps of:

storing a stack of documents in page sequence from bottom to top, the stack at least initially having each side of the documents to be copied face down;

feeding the documents one by one from the bottom of the stack;

conveying the documents along one of a first conveying route and a second conveying route to an exposure glass;

exposing a side of the document to be copied on the exposure glass;

conveying the documents from the exposure glass along one of a third conveying route and a fourth conveying route to the stack; and controlling the conveying of documents, the documents conveyed along the first and third conveying routes being inverted between the stack and the exposure glass to thereby have a different orientation when on the exposure glass than when in the stack and documents conveyed along the second and fourth conveying routes having a same orientation on the exposure glass as when in the stack.

27. The copying method according to claim 26, wherein during a first copying operation, the documents are conveyed from the stack through the second conveying route to the exposure glass whereafter the documents are conveyed along the third conveying route back to the stack such that the documents which were stacked face down are then stacked face up.

28. The copying method according to claim 27, further comprising the steps, after all documents are inverted to be face up in the stack, of feeding the documents one by one from the bottom of the stack and conveying the documents through the first conveying route to the exposure glass for a second time.

29. The copying method according to claim 28, further comprising the step of conveying documents on the exposure glass for a second time through the third conveying route to the stack if more than one copy is to be made.

30. The copying method according to claim 29, further comprising the step of conveying documents from the exposure glass to the stack through the fourth conveying route after a last copy of each document is made to thereby place the document face down in the stack.

31. A copying apparatus for obtaining one of collated simplex and duplex copies from simplex documents comprising:

exposure glass forming a first exposure region, initial means for storing the documents so that the side to be copied comes down piled up in page sequence, means for feeding the documents one by one from the final page on the bottom of the stack in the initial storing means to a second exposure region, means for returning the documents from the second exposure region into the initial storing means, means for copying the document image exposed in the first and second exposure regions onto a copying paper, means for temporarily storing the copying papers after copying, means for conveying the copying papers from a copying paper storing means into the copying means, means for discharging copying papers after copying to a final storing means, and means for controlling copying, when the documents are stored in the initial storing means and duplex copies are to be obtained, the means for controlling copying feeding every other page of the documents from the final page on one side of the copying papers while counting the number of documents in a first session of document feeding, storing the copying paper after copying in the temporary storing means, and in the second session of document feeding, feeding the copying paper from the temporary storing means, when the number of documents is odd, discharging without copying on the other side of the copying paper on which the final page of the documents is copied, and copying the remaining documents not copied in the first session of document feeding in the reverse page sequence on the other side of the copying papers on which the second page from the final one and after the documents are copied, and, when the number of documents is even, copying the remaining documents not copied in the first session of document feeding in the reverse page sequence on the other side of the copying papers after the final page of the documents and then discharging them face down to the final storing means, when the documents are directly on the exposure glass of the first exposure region and duplex copies are to be obtained exposing the document as is without conveying of the document, every other page of the copying papers being fed to the temporary storing means, after the copying paper is fed to the temporary storing means, a next document being copied on the reverse side of the copying paper, whereafter the copying paper is discharged face down to the final storing means, and when the documents are stored in the initial storing means or are directly on the exposure glass and simplex copies are to be obtained the means for controlling copying sequentially exposes the documents and feeds the copying papers to the final storing means without feeding the documents to the temporary storing means.

* * * * *